US005618133A

United States Patent [19]

Mitsui et al.

[11] Patent Number: 5,618,133

[45] Date of Patent: Apr. 8, 1997

[54] VIBRATING MECHANISM AND APPARATUS FOR GENERATING VIBRATIONS FOR A VIBRATION COMPACTING ROLLER WITH VARIABLE AMPLITUDE

[75] Inventors: Akira Mitsui; Kristian J. Guard; Hideki Iwakuma, all of Kitakatsushika-gun, Japan

[73] Assignee: Sakai Heavy Industries, Ltd., Tokyo, Japan

[21] Appl. No.: 348,102

[22] Filed: Nov. 25, 1994

[30] Foreign Application Priority Data

| | | | |
|---|---|---|---|
| Nov. 30, 1993 | [JP] | Japan | 5-300087 |
| Nov. 30, 1993 | [JP] | Japan | 5-300088 |
| Dec. 17, 1993 | [JP] | Japan | 5-317845 |
| Dec. 28, 1993 | [JP] | Japan | 5-337665 |

[51] Int. Cl.[6] ..... E01C 19/23

[52] U.S. Cl. ..... 404/117; 404/122; 74/87; 366/128

[58] Field of Search ..... 404/117, 122, 404/130; 74/87; 366/128; 172/40

[56] References Cited

U.S. PATENT DOCUMENTS

| | | | |
|---|---|---|---|
| 3,656,419 | 4/1972 | Boone | 404/117 |
| 3,966,344 | 6/1976 | Haker et al. | 404/117 |
| 4,187,036 | 2/1980 | Haker et al. | 404/117 |
| 4,221,499 | 9/1980 | Breitholz et al. | 404/117 |
| 4,342,523 | 8/1982 | Salani | 404/117 |
| 4,362,431 | 12/1982 | Cochran | 404/117 |
| 4,546,425 | 10/1985 | Breitholz | 404/117 X |
| 5,177,415 | 1/1993 | Quibel et al. | 404/117 X |

FOREIGN PATENT DOCUMENTS

| | | |
|---|---|---|
| 53-136773 | 11/1978 | Japan . |
| 2250798 | 6/1992 | United Kingdom . |

*Primary Examiner*—James A. Lisehora
*Attorney, Agent, or Firm*—Longacre & White

[57] ABSTRACT

A vibrating mechanism for vibrating a vibration compacting roller with a variable amplitude includes a vibration generating shaft, a movable eccentric weight turnably disposed in the vibration generating shaft, and an eccentric weight driving unit for rotating the eccentric weight about a pivotal shaft transversely extending relative to the vibration generating shaft. To generate vibrations for the vibration compacting roller, a vibration generating apparatus including a vibrating mechanism of the foregoing type is substantially composed of an eccentricity signal generating unit, a vibration mode setting unit, an eccentric weight eccentricity quantity detecting unit, and an eccentric weight eccentricity quantity controlling unit. Alternatively, the vibration generating apparatus may substantially be composed of a forward/rearward movement lever neutral position detecting unit and an eccentric weight eccentricity quantity controlling unit. Otherwise, the vibration generating apparatus may substantially be composed of a running speed detecting unit, a running speed setting unit a running speed comparing unit, and an eccentric weight eccentricity quantity controlling unit. The eccentric weight eccentricity quantity controlling unit is usually composed of a hydraulic cylinder, a hydraulic pump, a connecting rod, and solenoid driven change valves. In addition, a vibration generating method to be practiced by operating a vibration generating apparatus of the foregoing type is also provided.

11 Claims, 11 Drawing Sheets

FIG. 11(a-2)
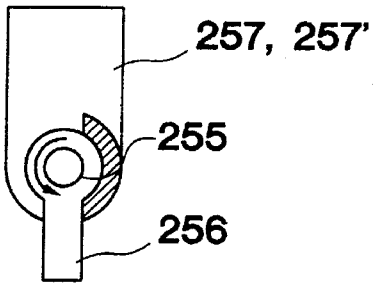
FIG. 11(b-2)
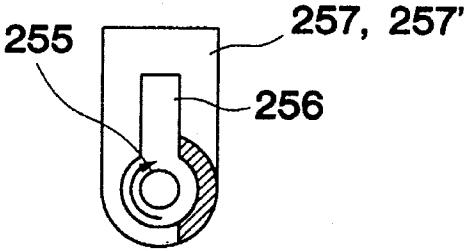
FIG. 11(a-1)
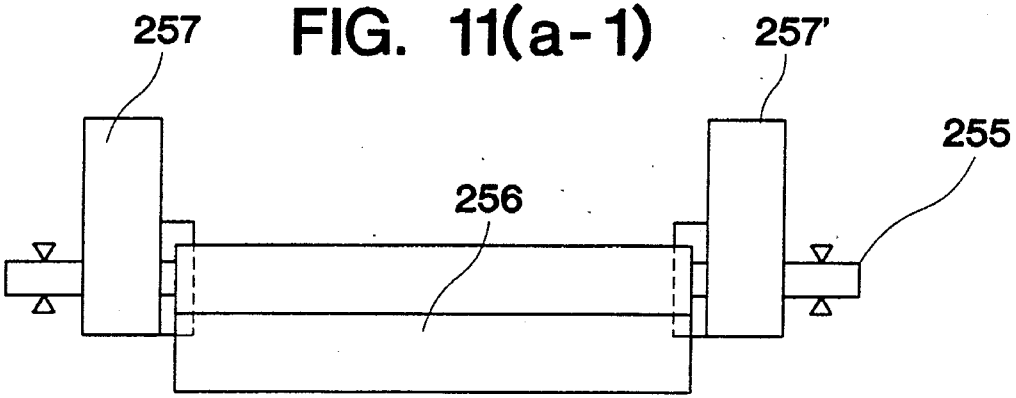
FIG. 11(b-1)
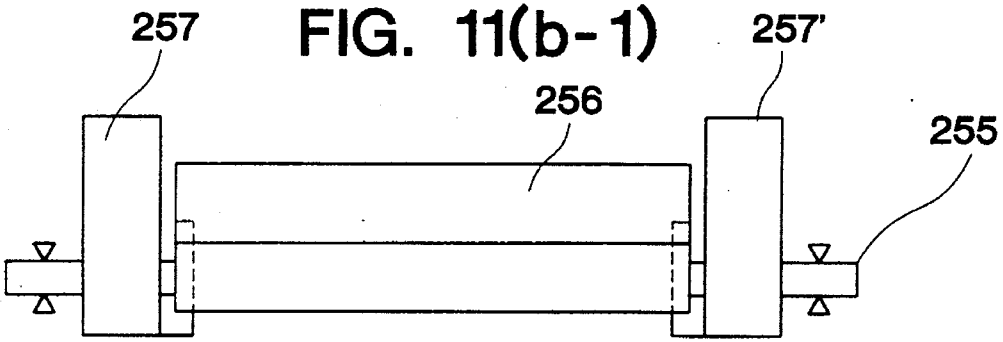

VIBRATING MECHANISM AND APPARATUS FOR GENERATING VIBRATIONS FOR A VIBRATION COMPACTING ROLLER WITH VARIABLE AMPLITUDE

BACKGROUND OF THE INVENTION

1. Field of the Invention

The present invention relates to a vibrating mechanism which assures that a movable eccentric weight can simply be supported in a cylindrical casing thereof, and moreover, components constituting the vibrating mechanism can easily be assembled in the cylindrical casing. More particularly, the present invention relates to a mechanism for vibrating an amplitude variable type vibration compacting roller with the aid of the foregoing components. Further, the present invention relates to an apparatus for generating vibrations for a vibration compacting roller with a variable amplitude wherein the apparatus can properly control a quantity of eccentricity of the gravity center of a movable eccentric weight away from the center axis of a vibration generating shaft in the foregoing vibrating mechanism corresponding to given requirements. Moreover, the present invention relates to a method of generating vibrations for a vibration compacting roller with a variable amplitude by operation an apparatus of the foregoing type.

2. Description of the Related Art

Conventionally, a vibrating mechanism of the type for generating a certain intensity of vibration generating force by rotating a vibration generating shaft including a movable eccentric weight to utilize the centrifugal force induced by the eccentric weight has been often employed for a vibration utilizing machine such as a vibration utilizing type soil compacting roller, a vibration utilizing type pile driving machine or the like. When a certain given operation is performed using the vibrating mechanism, it is desirable that an amplitude of each vibration can be changed corresponding to given working conditions and so forth.

Here, it is assumed that a vibrating mechanism of the foregoing type is applied to a vibration compacting roller as a typical example of practical use thereof. To achieve a ground surface compacting operation at a high efficiency by operating the vibrating mechanism, it is desirable that an amplitude of each vibration is changed to another one depending on the kind of material to be compacted, a thickness of the compacted material and other conditions.

On the other hand, with respect to a conventional apparatus for generating variations for a vibration compacting roller with a variable amplitude (hereinafter referred to as a conventional vibration generating apparatus), many proposals have been hitherto made. Typically, the conventional vibration generating apparatus includes as essential components a vibration generating shaft disposed in a vibration rolling drum of the vibration compacting roller, a rotational driving unit for rotationally driving the vibration generating shaft in the normal/reverse direction, and a vibration generating force changing unit capable of changing a quantity of eccentricity of the gravity center of the eccentric weight away from the center axis of the vibration generating shaft. The fundamental structure of the conventional vibration generating apparatus is as shown in FIG. 11. Specifically, the conventional vibration generating apparatus includes a stationary eccentric weight 256 secured to a vibration generating shaft 255 and a pair of movable eccentric weight 257 and 257' each adapted to be turned relative to the stationary eccentric weight 256 so that the operative state represented by a low amplitude of each vibration is changed to the operative state represented by a high amplitude of each vibration, and vice versa depending on the direction of rotation of the vibration generating shaft 255, and moreover, an intensity of vibration generating force can be changed to another one by changing a quantity of eccentricity of the gravity center of each of the movable eccentric weights 257 and 257' away from the center axis of the vibration generating shaft 255 to another one. For example, when the vibration generating shaft 255 is rotated in the normal direction, the direction of deviation of the gravity center of each of the movable eccentric weights 257 and 257' away from the center axis of the vibration generating shaft 255 are reversely oriented in the opposite direction to the stationary eccentric weight 256 as represented by FIG. 11(*a*-1) and FIG. 11(*a*-2), whereby the vibration generating force is exerted on the vibration generating shaft 255 in such a direction that it is canceled, resulting in the vibration generating shaft 255 being rotated with a low amplitude of each vibration. On the contrary, when the vibration generating shaft 255 is rotated in the reverse direction, the direction of orientation of the stationary eccentric shaft 256 and the direction of deviation of the gravity center of each of the movable eccentric weights 257 and 257' away from the center axis of the vibration generating shaft 255 coincide with each other as represented by FIG. 11(*b*-1) and FIG. 11(*b*-2), resulting in the vibration generating shaft 255 being rotated with a high amplitude of each vibration because of the synthesization of both the vibration generating forces induced by the movable eccentric weights 257 and 257'.

The reason why a plurality of amplitudes, i.e., a high amplitude, a low amplitude and an intermediate amplitude of each vibration are required consists in a necessity for effectively performing a compacting operation by changing the applicable amplitude depending on a material to be compacted, a thickness of the material and so forth. For example, in the case that an asphalt based pavement material is compacted with a small thickness, each compacting operation is achieved with a low amplitude of each vibration in order to assure that gravel (crushed stone pieces) in the asphalt based pavement material is not broken or cracked, and moreover, surface flatness of the compacted material is not deteriorated due to the compaction operation achieved with a high magnitude of compacting force. On the other hand, when a soil based material supplied in the form of a belt having a large thickness is compacted like a compacting operation to be performed with a road bottom material, it is compacted with a high amplitude of each vibration in order to assure that a lower layer of the paved road can reliably be compacted with the vibration compacting roller.

When the vibrating rolling drum stopped under the condition in which said rolling drum is given vibration by rotating said vibration generating shaft 255, the compacted surface of the paved road brought in contact with said rolling drum is largely lowered. Thus it becomes difficult to finish the surface of the paved road smoothly. To prevent the foregoing malfunction from arising, a neutral position detecting limit switch is hitherto disposed on a frame having a forward/rearward movement lever mounted thereon in such a manner that the foregoing limit switch is actuated to the ON side when the forward/rearward movement lever is located at a forward movement position or at a rearward movement position, and it is actuated to the OFF side when the forward/rearward movement lever is located at a neutral position (stopped position).

FIG. 8 is a side view of a forward/rearward movement initiating unit 170, particularly showing the relationship between a forward/rearward movement lever 130 for the vibration compacting roller and a hydraulic pump operatively connected to each other to drivably running the vibration compacting roller. In response to a command issued to a vibration compacting roller driving system to instruct that the vibration compacting roller is caused to run with the aid of the forward/rearward movement initiating unit 170 by selectively displacing the forward/rearward movement lever 130 on an operator's seat to one of a forward movement position A, a neutral (stopped) position B and a rearward movement position C. The fundamental structure of the forward/rearward movement initiating unit 170 is such that an actuating arm 132 secured to a base shaft 131 is operatively associated with the forward/rearward movement lever 130, and a controlling lever 134 is operatively connected to the actuating arm 132 via a control cable 135 in order to change the direction of rotation of a variable capacity type hydraulic pump 133 to the opposite one for drivably running the vibration compacting roller, whereby a turning stroke of the actuating arm 132 is transmitted to the control lever 134. The variable capacity type hydraulic pump 133 is hydraulically connected to a vibration generating hydraulic motor (not shown) via a piping to vibratively drive the vibration rolling drum.

A cam 136 is formed integral with the base shaft 131, and a neutral position detecting limit switch 138 serving as forward/rearward movement lever neutral position detecting means is disposed on the frame 137 having the forward/rearward movement lever 130 mounted thereon. As the cam 135 is turnably displaced, the neutral position detecting limit switch 138 detects whether or not the forward/rearward movement lever 130 is located at one of the forward movement position A, the rearward movement position C and the neutral position B.

An amplitude changing switch 253 serving as vibration mode setting means is disposed in a signal circuit shown in FIG. 9 so as to actuate a solenoid driven change valve 252 shown in FIG. 10 that is a hydraulic circuit diagram. When the amplitude changing switch 253 shown in FIG. 9 is changeably actuated to the opposite side, the direction of supplying pressurized hydraulic oil from the hydraulic pump 251 to the hydraulic motor 250 shown in FIG. 10 is changed to the opposite direction, causing the direction of rotation of the hydraulic motor 250 to be changed from the normal direction to the reverse direction, and vice versa. The rotational driving force of the hydraulic motor 250 is transmitted to the vibration generating shaft 255 integrally connected to an output shaft of the hydraulic motor 250 in such a manner as to allow the vibration generating shaft 255 to be rotated in the same direction as that of the hydraulic motor 250. In FIG. 9, reference numeral 257 designates an automatic/manual changing switch.

When the running of the vibration compacting roller is stopped with the forward/rearward movement lever 130 shown in FIG. 8 displaced to the neutral position B as vibrations generated by the vibration generating shaft 255 are applied to the vibration rolling drum, the compacted ground surface having the vibration compacting roller brought in contact therewith in the vibration stopped state is largely lowered. Thus, it becomes difficult to smoothly finish the compacted road surface. To prevent the foregoing malfunction from arising, the neutral position detecting limit switch 138 serving as forward/rearward movement lever neutral position detecting means is hitherto actuated to the OFF side when the forward/rearward movement lever 130 is located at the position in the vicinity of the neutral position B between the forward movement position A and the rearward position C in order to enable the neutral position B of the forward/rearward movement lever 130 to be detected. Subsequently, the neutral position detecting limit switch 138 activates a vibration shaft rotation controlling unit 266. Specifically, a solenoid driven change valve 252 shown in FIG. 10 is restored to the original position thereof so that the supplying of pressurized hydraulic oil from the hydraulic pump 251 to the hydraulic motor 250 is interrupted with the result that the rotation of the vibration generating shaft 255 is stopped and the vibrative running of the vibration compacting roller is stopped. When the forward/rearward movement lever 130 is displaced to the forward movement A side or the rearward movement C side, the neutral position detecting limit switch 138 is actuated to the ON side again to activate the solenoid driven change valve 252, whereby pressurized hydraulic oil is supplied from the hydraulic pump 251 to the hydraulic motor 250, causing the vibration generating shaft 255 to be rotated so as to allow vibrations to be applied to the vibration compacting roller.

In the case of the conventional vibration compacting roller constructed in the above-described manner, when the forward/rearward movement lever 130 is displaced from the forward movement position A or the rearward movement position C to the neutral position B, the rotation of the vibration generating shaft 255 is stopped. However, the operative state of the vibration compacting roller coincides with a resonance point defined by the vibration rolling drum and the frame as well as another resonance point defined by the vibration rolling drum and the compacted ground surface in the course of shifting from the steady state having the vibration generating shaft 255 held in the rotating state to the immovable state having the vibration generating shaft 255 held in the vibration stopped state, resulting in the vibration rolling drum being caused to resonate. FIG. 12 is a graph which shows by way of example how the relationship among the number of revolutions of the vibration generating shaft, a magnitude of deviation of the gravity center of each of the movable eccentric weights 257 and 257' away from the center axis of the vibration generating shaft 255, and an intensity of decelerated vibration varies for a period of time from the state that the vibration generating shaft 255 is steadily rotated till the state that the rotation of the vibration generating shaft 255 is stopped, as time elapses. As is apparent from the graph, the number of revolutions of the vibration generating shaft 255 is gradually reduced from the point of time when the forward/rearward movement lever 130 is displaced to the neutral position, and in the shown case, the operative state of the vibration compacting roller coincides with a resonance point after a period of five seconds elapses. Obviously, at this time, the magnitude of deviation of the center axis of the vibration rolling drum away from that of the vibration compacting roller, i.e., an amplitude of each vibration is increased. Once the operative state of the vibration compacting roller coincides with the foregoing resonance point, a number of small corrugated ruggednesses are formed on the compacted ground surface having the vibration rolling drum brought in contact therewith.

On the contrary, when the forward/rearward movement lever 130 is displaced from the neutral position C to the forward movement position A or the rearward movement position B, the vibration rolling drum coincides with the resonance point in the course of shifting from the state that the number of revolution of the vibration generating shaft 255 is increased to that corresponding to the steady rotating state of the vibration generating shaft 255, resulting in the vibration rolling drum being likewise caused to resonate.

Consequently, another drawback of the vibration rolling drum is such that a number of small corrugated ruggednesses are likewise formed on the compacted ground surface having the vibration rolling drum brought in contact therewith.

Usually, the vibration compacting roller reciprocably moves on the road surface within a predetermined working range several times to perform a rolling operation with the vibration rolling drum while the forward/rearward movement lever is changeably displaced with an operator's hand. Conventionally, however, since the rotation of the vibration generating shaft 255 is stopped every time the forward/rearward movement lever 130 is located at the neutral position (corresponding to the position where the rotation of the vibration rolling drum is stopped), it is necessary that starting and stopping of the rotation of the vibration generating shaft 255 are frequently conducted. This leads to the result that a large magnitude of load should be borne by the hydraulic pump and the vibration generating hydraulic motor every time the forward/rearward movement lever 130 is located at the neutral position, resulting in a large amount of energy loss arising. In addition, a large amount of time loss is caused not only when the vibration generating shaft 255 starts to be rotated but also when the rotation of the vibration generating shaft 255 is stopped.

With respect to a vibration compacting roller driving system wherein the direction of rotation of the vibration generating shaft 255 is changed to the opposite one to change an amplitude of each vibration to another one, there arises a problem that when the direction of rotation of the vibration generating shaft 255 in a certain direction is reversed while the rotation of the vibration generating shaft 255 is not still held in the vibration stopped state, the movable eccentric weights 257 and 257' are rotated further under the influence of inertia force induced in the foregoing state until they collide against an engagement portion of the stationary eccentric weight 256, resulting in components associated with the vibration generating shaft 255 being damaged or injured. In addition, since the direction of rotation of the vibration generating shaft 255 is reversed after it is once stopped when the direction of rotation of the vibration generating shaft 255 is changed to the opposite one, there arises another problem that a large amount of loss in a vibration rising time as well as a large amount of loss in a vibration stoppage time are caused, resulting in a large amount of energy being uselessly lost.

On the other hand, another example of a conventional variable amplitude type vibrating mechanism of the type adapted to change an amplitude of each vibration to another one without any changing of the direction of rotation of a vibration generating shaft to another one is disclosed in an official gazette of Japanese Patent Laid-Open Publication NO. 53-136773. This vibrating mechanism constructed according to the prior invention will be described below with reference to FIG. 13.

A cylindrical casing 51 includes cantilever-like shafts 56 and 57 on the opposite sides to serve as bearings. The cylindrical casing 51 is supported by end plates of a vibration rolling drum (not shown). A movable eccentric weight 52 is turnably disposed in the cylindrical casing 51 to turn around a pivotal shaft 53 which extends through the center axis of the cylindrical casing 51 at a right angle relative to the latter. With this construction, a magnitude of eccentric moment induced by the eccentric weight 52 can be changed to another one by dislocating the eccentric weight 52 around the pivotal shaft 52 in the cylindrical casing 51 so as to enable a quantity of vibrative movement transmitted from the eccentric weight 52 to the vibration rolling drum to be adjusted as desired.

According to the prior invention, the adjustment of the vibrative movement is achieved with the aid of an adjusting unit which is substantially composed of a plate 55 having a longitudinally extending slot 54 formed therethrough so as to enable the position of the slot 54 to be adjusted in the axial direction of the cylindrical casing 51. The right-hand end of the plate 55 is fixedly secured to an adjusting rod 58, while the left-handed end of the plate 55 is fixedly secured to an annular adjusting device 59. The pivotal shaft 53 for the eccentric weight 52 extends through the slot 54 of the plate 55, and the plate 55 can slidably be displaced in the longitudinal direction of the adjusting rod 58 without any hindrance caused due to the presence of the pivotal shaft 53. The eccentric weight 52 includes a driving rod 60 which extends through the slot 54 of the plate 55 in the transverse direction. As the plate 55 is axially displaced by the adjusting rod 58 in the leftward direction, the eccentric weight 52 is turnably displaced around the pivotal shaft 53 by the driving rod 60 while scribing a pivotal locus therewith, causing a magnitude of eccentric moment induced by the eccentric weight 52 to be changed as desired. Thus, an amplitude of vibrative movement induced by the eccentric weight 52 during rotation of the cylindrical casing 51 can be changed to another one corresponding to the deviation of the gravity center of the eccentric weight 52 from the center axis of the cylindrical casing 51.

Since the vibrating mechanism is constructed in the above-described manner, a hydraulic system and an eccentricity adjusting system for the vibrating mechanism can be designed with minimized dimensions, resulting in a danger of causing oil leakage from the hydraulic system being reduced or alleviated. In addition, an intensity of hydraulic pressure applied to the hydraulic system can reliably be set to a desired value.

In spite of the advantageous feature of the vibrating mechanism as mentioned above, the conventional vibrating mechanism has problems as noted below. Thus, many requests have been raised from users for solving these problems.

1. Since the cylindrical casing 51 is not designed to exhibit an opened structure, it is difficult to insert the eccentric weight 52 and associated components in the cylindrical casing 51 for assembling them together in the cylindrical casing 51. For this reason, it is not easy to perform an assembling operation with these components.
2. While vibrations are successively generated by the vibrating mechanism, the cylindrical casing 51 is rotated at a high rotational speed, causing lubricant in the cylindrical casing 51 to forcibly adhere to the inner wall surface of the cylindrical casing 51 under the influence of the centrifugal force induced by the rotation of the cylindrical casing 51. This leads to the result that lubricant is less liable of reaching locations to be lubricated. Thus, it is difficult to properly lubricate the foregoing locations with the lubricant.
3. As the adjusting rod 58 is displaced in the above-described manner, the driving rod 60 fitted to the eccentric weight 52 is followably displaced along a vertically extending slot 61 formed at a part of the slot 54, causing the adjusting rod 58 to be rotated about the center of turning movement of the eccentric weight 52. Thus, the driving rod 60 comes in slidable contact with the slot 61. As the adjusting rod 58 is repeatedly displaced in that way, the driving rod 60 increasingly wears, resulting in the driving rod 60 being rattled in the slot 61 due to the wearing of the driving rod 60. It is anticipated that it becomes difficult to properly locate the eccentric weight 52 in the cylindrical casing 51.

4. Since the whole vibrating mechanism including the eccentric weight 52 and associated components is designed to exhibit such a closed structure that all the components are received in the cylindrical casing 51, a magnitude of inertia moment induced by the rotation of the cylindrical casing 51 is enlarged. Thus, a long time is required until the cylindrical casing 51 is rotated at a predetermined rotational speed, and moreover, a high intensity of energy is required to rotate the cylindrical casing 51 at a predetermined rotational speed. In addition, a long time is required until the rotation of the cylindrical casing 51 is stopped by reducing the rotational speed of the cylindrical casing 51 from the predetermined one.

Further, with respect to a conventional variable amplitude type vibration rolling drum adapted to change amplitude of each vibration to another one without changing the direction of rotation of the vibration generating shaft as shown in FIG. 13, there has been no disclosure in prior art as to how to control the amplitude of each vibration. This has been considered to be a problem preventing simple control operation of the vibration rolling drum in the practical operation.

SUMMARY OF THE INVENTION

The present invention has been made in consideration of the aforementioned background.

An object of the present invention is to provide a vibrating mechanism employable for a variable amplitude type vibration compacting roller wherein the vibrating mechanism assures that a movable eccentric weight can simply be supported in a cylindrical casing, and essential components constituting the vibrating mechanism can easily be assembled in the cylindrical casing.

Other object of the present invention is to provide an apparatus for generating vibrations for a vibration compacting roller with a variable amplitude wherein the apparatus assures that it is not necessary that the direction of rotation of a vibration generating shaft is changed to the opposite one every time a vibration mode is changeably selected, and a quantity of eccentricity of the vibration generating shaft can automatically be controlled to have an amplitude of each vibration corresponding to the selected vibration mode.

Another object of the present invention is to provide an apparatus for generating vibrations for a vibration compacting roller with a variable amplitude wherein the apparatus assures that in the case that a forward/rearward movement lever is displaced from a forward movement position or a rearward movement position to a neutral position when e.g., an asphalt based pavement material is compacted by rolling, vibration of a vibration rolling drum can be stopped without any occurrence of resonance of the vibration rolling drum, in the case that the forward/rearward movement member is displaced from the neutral position to the forward movement position or the rearward movement position, vibrations can be generated without any occurrence of resonance of the vibration rolling drum, and moreover, when vibration of the vibration rolling drum is stopped, the compacted surface of the asphalt based pavement material is not largely lowered and any small corrugated ruggedness is not formed on the compacted surface of the asphalt based pavement material.

Further object of the present invention is to provide an apparatus for generating vibrations for a vibration compacting roller with a variable amplitude wherein the apparatus assures that in the case that a running speed of the vibration compacting roller is lower than a predetermined running speed, vibration of the vibration compacting roller can be stopped without any occurrence of resonance of a vibration rolling drum, in the case that the running speed of the vibration compacting roller is higher than the predetermined running speed, vibrations can be generated without any occurrence of resonance of the vibration rolling drum, and when vibration of the vibration compacting roller is stopped, the compacted surface of a material to be compacted is not lowered, and moreover, any small corrugated ruggedness is not formed on the compacted surface of the foregoing material.

Further another object of the present invention is to provide a method of generating vibrations for a vibration compacting roller with a variable amplitude by operating an apparatus of the foregoing type.

According to a first aspect of the present invention, there is provided a vibrating mechanism which comprises a vibration generating shaft composed of a pair of supporting members disposed in the spaced relationship while facing to each other, a movable eccentric weight turnably supported between the pair of supporting members to turn in the direction orienting at a right angle relative to the center axis of the vibration generating shaft, and eccentric weight driving means for rotating the eccentric weight about a pivotal shaft transversely extending relative to the vibration generating shaft. With this construction, the eccentric weight driving means serves to deviate the gravity center of the eccentric weight away from the center axis of the vibration generating shaft.

Concretely, the eccentric weight driving means is composed of an actuator, a shaft projecting outside of the actuator, a joint rotatably fitted to the shaft, and a connecting rod of which one end is operatively connected to the joint side and of which other end is operatively connected to the eccentric weight side. At this time, the connecting rod serves to transform the linear movement of the joint away from the actuator into the turning movement of the eccentric weight about the pivotal shaft transversely extending relative to the vibration generating shaft.

With such construction, the supporting members disposed in the spaced relationship while facing to each other to constitute the vibration generating shaft which turnably supports the eccentric weight in the direction orienting at a right angle relative to the pivotal shaft transversely extending relative to the center axis of the vibration generating shaft, and the eccentric weight driving means turnably displaces the eccentric weight about the pivotal shaft transversely extending relative to the center axis of the vibration generating shaft to deviate the gravity center of the eccentric weight away from the center axis of the vibration generating shaft.

In addition, according to a second aspect of the present invention, there is provided a variable amplitude type vibration compacting roller which includes a vibrating mechanism constructed according to the first aspect of the present invention.

Additionally, according to a third aspect of the present invention, there is provided an apparatus for generating vibrations for a vibration compacting roller with a variable amplitude, the apparatus including a vibrating mechanism adapted to change an amplitude of each vibration to another one by deviating the gravity of a movable eccentric weight in a vibration generating shaft away from the center axis of the vibration generating shaft, wherein the apparatus comprises eccentricity signal generating means for generating a signal for deviating the gravity center of the eccentric weight away from the center axis of the vibration generating shaft, vibration mode setting means capable of selectively setting an amplitude of each vibration, eccentric weight eccentricity quantity detecting means for detecting a quantity of eccentricity of the eccentric weight, eccentric weight eccentricity quantity controlling means for controlling a quantity of eccentricity of the eccentric weight with the aid of vibration mode setting means for setting a desired vibration mode as well as the eccentric weight eccentricity quantity detecting means in response to a signal transmitted from the eccentricity signal generating means.

With this construction, when a forward/rearward movement lever is displaced to a neutral position to change the present vibration mode to another one, forward/rearward movement lever neutral position detecting means detects the neutral position, and subsequently, the eccentric weight eccentricity quantity controlling means locates the gravity center of the eccentric weight substantially on the axis line of the vibration generating shaft in response to a signal transmitted from the eccentricity signal generating means to instruct that the neutral position is detected, whereby an intensity of vibration generating force is reduced to a level of zero. While the vibration generating shaft is continuously rotated without any changing of the direction of rotation of the vibration generating shaft to the opposite one, the eccentric weight eccentricity quantity controlling means controls a quantity of eccentricity of the eccentric weight in such a manner as to generate vibrations each having an amplitude corresponding to that set by the vibration mode setting means.

Further, according to a fourth aspect of the present invention, there is provided an apparatus for generating vibrations for a vibration compacting roller with a variable amplitude, the apparatus including a vibrating mechanism adapted to change an amplitude of each vibration to another one by deviating the gravity center of a movable eccentric weight in a vibration generating shaft away from the center axis of the vibration generating shaft, wherein the apparatus comprises forward/rearward movement lever neutral position detecting means for detecting a neutral position of a forward/rearward lever, and vibration shaft eccentricity quantity controlling means for locating the gravity center of the eccentric weight substantially on the center axis of the vibration generating shaft in response to a signal transmitted from the forward/rearward movement lever neutral position detecting means to instruct that the neutral position is detected.

It is advantageously acceptable that the eccentric weight eccentricity quantity controlling means is constructed in such a manner that the gravity center of the eccentric weight is located substantially on the center axis of the vibration generating shaft in response to a signal transmitted from the forward/rearward movement lever neutral position detecting means to instruct that the neutral position is detected while the vibration generating shaft is steadily rotated without any stopping of rotation thereof.

With this construction, when the forward/rearward movement lever is displaced from the forward movement position or the rearward movement position to the neutral position, the forward/rearward movement lever neutral position detecting means detects the neutral position, and subsequently, the eccentric weight eccentricity quantity controlling means serves to locate the gravity center of the eccentric weight substantially on the center axis in response to a signal transmitted from the forward/rearward movement lever neutral detecting means to instruct that the neutral position is detected, causing no vibration to be generated by the vibration generating shaft. Thereafter, when the forward/rearward movement lever is displaced from the neutral position to the forward movement position or the rearward movement position, the gravity center of the eccentric weight is deviated away from the center axis of the vibration generating shaft which in turn generate vibrations as it is rotated.

Moreover, according to a fifth aspect of the present invention, there is provided an apparatus for generating vibrations for a vibration compacting roller with a variable amplitude, the apparatus including a vibrating mechanism adapted to change an amplitude of each vibration to another one by deviating the gravity center of a movable eccentric weight in a vibration generating shaft away from the center axis of the vibration generating shaft, wherein the apparatus comprises running speed detecting means for detecting a running speed of the vibration compacting roller, running speed setting means, running speed comparing means for comparing the running speed of the vibration compacting roller detected by the running speed detecting means with a running speed of the vibration compacting roller set by the running speed setting means by comparing a signal transmitted from the running speed detecting means with a signal transmitted from the running speed setting means, in order to whether or not the running speed of the vibration compacting roller detected by the running speed detecting means is higher than the running speed of the vibration compacting roller set by the running speed setting means, and eccentric weight eccentricity quantity controlling means for locating the gravity center of the eccentric weight substantially on the center axis of the vibration generating shaft in response to a signal transmitted from the running speed comparing means when a running speed of the vibration compacting roller detected by the running speed detecting means is lower than a running speed of the vibration compacting roller set by the running speed setting means, and deviating the gravity center of the eccentric weight away from the center axis of the vibration generating shaft in response to the foregoing signal when the running speed of the vibration compacting roller detected by the running speed detecting means is higher than the running speed of the vibration compacting roller set by the running speed setting means.

The eccentricity signal generating means includes forward/rearward movement lever neutral position detecting means for detecting whether or not a forward/rearward movement lever for instructing a command of forward movement, stoppage or rearward movement of the vibration compacting roller to a vibration compacting roller driving system is located at a neutral position, and when the forward/rearward movement lever is located at the position other than the neutral position, the eccentricity signal generating means generates an eccentricity signal.

In addition, the eccentricity signal generating means includes running speed detecting means for detecting the present running speed of the vibration compacting roller in response to a signal transmitted from the vibration compacting roller driving system and running speed comparing means for comparing the running speed of the vibration compacting roller detected by the running speed detecting means with the running speed of the vibration compacting roller set by the running speed setting means, and when the running speed of the vibration compacting roller detected by the running speed detecting means is higher than the running speed of the same set by the running speed setting means, the eccentricity signal generating means generates an eccentricity signal.

Further, the eccentric weight eccentricity quantity controlling means includes an actuator for changing a quantity of eccentricity of the gravity center of the eccentric weight away from the center axis of the vibration generating shaft to another one by displacing the eccentric weight and solenoid driven change valves for controlling the movement of the actuator, and the eccentric weight eccentricity quantity detecting means includes a plurality of eccentricity quantity detecting sensors electrically connected to solenoid coils of the solenoid driven change valves via signal lines for activating the actuator in such a manner so as to increase a quantity of eccentricity of the eccentric weight. Each of the eccentricity quantity detecting sensors is activated when a movable portion of the actuator is displaced by a predetermined distance corresponding to a predetermined quantity of eccentricity.

In response to the signal transmitted from the running speed comparing means, the eccentric weight eccentricity quantity controlling means serves to locate the gravity center of the eccentric weight substantially on the center axis of the vibration generating shaft without any stopping of rotation of the vibration generating means, when the running speed of the vibration compacting roller detected by the running speed detecting means is lower than the running speed of the vibration compacting roller set by the running speed setting means. Otherwise, in response to the foregoing signal, the eccentric weight eccentricity quantity controlling means may locate the gravity center of the eccentric weight substantially on the center axis of the vibration generating shaft while the latter is steadily rotated, when the running speed of the vibration compacting roller detected by the running speed detecting means is lower than the running speed of the vibration compacting roller set by the running speed setting means.

Furthermore, according to a sixth aspect of the present invention, there is provided a method of generating vibrations for a vibration compacting roller with a variable amplitude, wherein the method comprises a step of displacing a movable eccentric weight in a vibration generating shaft in such a manner that the gravity center of the eccentric weight is located substantially on the center axis of the vibration generating shaft so as to allow the vibration compacting roller to be held in the vibration stopped state in response to a detection signal derived from detecting of a running speed of the vibration compacting roller when the running speed of the vibration compacting roller is lower than a first predetermined running speed, and a step of displacing the eccentric weight in such a manner that the gravity center of the eccentric weight is deviated away from the center axis of the vibration compacting roller so as to allow the vibration compacting roller to be held in the vibration generating state in response to the foregoing signal when the running speed of the vibration compacting roller is higher than a second predetermined running speed.

With this vibration generating method, when the running speed of the vibration compacting roller is lower than the first predetermined running speed during a rolling operation performed by the vibration compacting roller, the gravity center of the eccentric weight is located substantially on the center axis of the vibration generating shaft, and when the running speed of the vibration compacting roller is higher than the second predetermined running speed, the eccentric weight is displaced in such a manner than the gravity center of the eccentric weight is deviated away from the center axis of the vibration generating shaft.

Other objects, features and advantages of the present invention will readily become apparent from reading of the following description which has been made in conjunction with the accompanying drawings.

BRIEF DESCRIPTION OF THE DRAWINGS

FIG. 11(*a*-1), FIG. 11(*a*-2), FIG. 11(*b*-1) and FIG. 11(*b*-2) are schematic views which illustrate the operative state of the vibration generating apparatus for the vibration compacting roller and the eccentric weight vibrating with a low amplitude as well as a high amplitude, respectively.

DESCRIPTION OF THE PREFERRED EMBODIMENTS

The present invention will now be described in detail hereinafter with reference to the accompanying drawings which illustrate preferred embodiments thereof.

Figure 8:
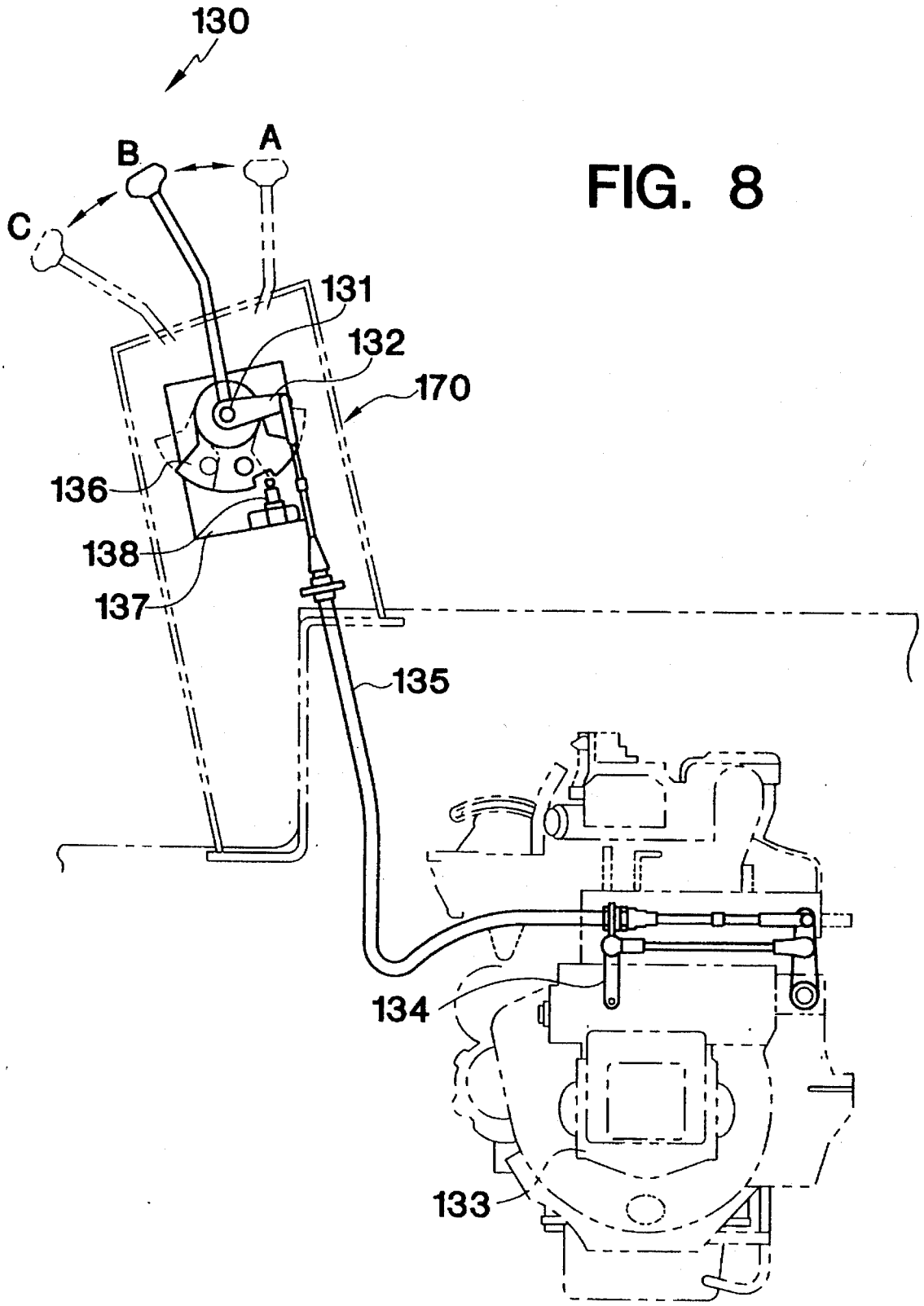
FIG. 8 is a side view of a forward/rearward movement initiating unit, particularly showing the relationship between a forward/rearward movement lever and a hydraulic pump arranged for drivably running the vibration compacting roller.

First, an apparatus for generating vibrations for a vibration compacting roller with a variable amplitude (hereinafter referred to simply as a vibration generating apparatus) constructed in accordance with a first embodiment of the present invention will be described below with reference to FIG. 8. In this embodiment, the vibration generating apparatus includes a forward/rearward movement initiating unit 170 which is substantially composed of a forward/rearward movement lever 130 adapted to be displaced to one of a forward movement position A, a neutral (stopped) position B and a rearward movement position, a control lever 134 operatively associated with the forward/rearward movement lever 130 to change the direction of rotation of a variable capacity type hydraulic pump 133 to the opposite one and change the running speed of the vibration compacting roller for drivably running the vibration compacting roller to another one, and a neutral position detecting limit switch 138 serving as forward movement/rearward movement lever neutral position detecting means to detect with the aid of a cam 136 operatively associated with the forward/rearward movement lever 130 whether or not the forward/rearward movement lever 130 is located at one of the forward movement position A, the rearward movement position C and the neutral position B in the same manner as the conventional vibration generating apparatus as described above. In this embodiment, an eccentricity signal generating unit is substantially composed of the forward/rearward movement lever 130 which serves to issue a command for forward movement or rearward movement of the vibration compacting roller to a vibration compacting roller driving system, and when the forward/rearward movement lever 130 is located at the position other than the neutral position, an eccentricity signal is generated by the eccentricity signal generating unit.

Figure 1:
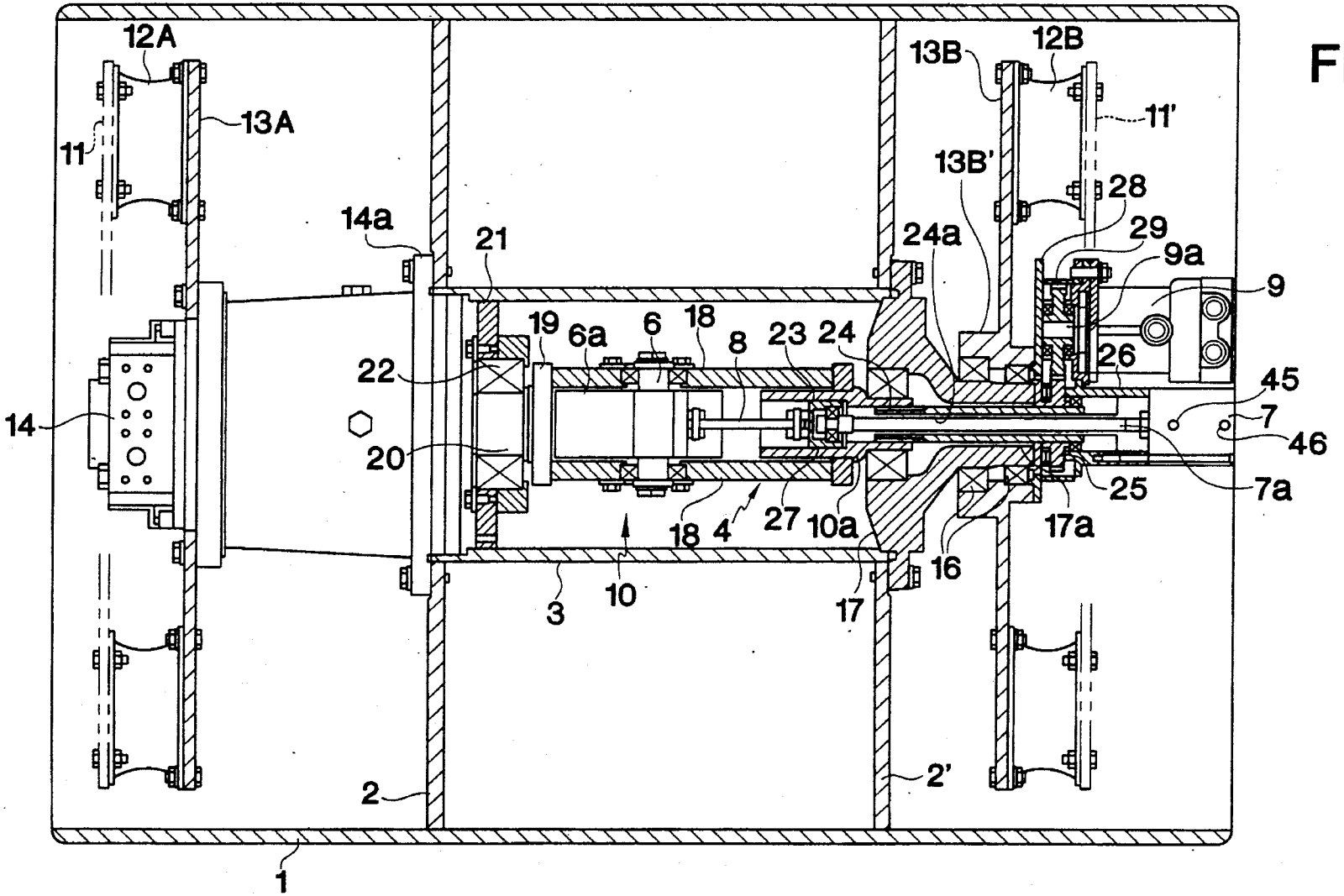
FIG. 1 is a sectional plan view which shows the structure of an amplitude variable type vibration compacting roller including a vibrating mechanism constructed in accordance with each of first and second embodiments of the present invention.

FIG. 1 is a sectional plan view of the vibration generating apparatus for a vibration compacting roller constructed in accordance with the first embodiment of the present invention. As shown in FIG. 1, a vibration rolling drum 1 includes mirror plates 2 and 2' in the spaced relationship as seen in the axial direction, and a cylindrical casing 3 for a vibrating mechanism 4 to be described later is fixedly secured to the mirror plates 2 and 2' on the opposite sides thereof. The vibrating mechanism 4 for generating vibrations for the vibration compacting roller with a variable amplitude is received in the cylindrical casing 1. A supporting member 13A is fitted to a left-hand frame 11 for the vibration compacting roller (not shown) via a plurality of vibration proofing members 12A, and a hydraulic motor 14 including a speed reducing unit for drivably running the vibration compacting roller is attached to the supporting member 13A. Since a rotational driving portion **14*a* of the hydraulic motor 14 is affixed to the mirror plate 2 of the vibration rolling drum 1, the vibration rolling drum 1 is caused to roll as the rotational driving portion 14** is rotated.

Similarly, a supporting member 13B is fitted to a right-hand frame 11' for the vibration compacting roller via a plurality of vibration proofing members 12B, and a rotatable wheel member 17 having a shaft hole **17*a* formed therein is rotatably supported in a bearing member 13B' of the supporting member 13B with a bearing 16 interposed therebetween. The rotatable wheel member 17 is affixed to the right-hand mirror plate 2. Two elongated plate-shaped supporting members 18 are arranged in the spaced relationship in the cylindrical casing 3 while facing to each other. A pivotal shaft 6 is bridged between both the supporting members 18, and a movable eccentric weight 6*a* is firmly fitted onto the pivotal shaft 6 in such a manner as not to be rotated about the latter. The left-hand ends of the supporting members 18 are affixed to a cover member 19, and a boss portion 20 of the cover member 19 is rotatably supported by a supporting member 21 located in the vicinity of the left-hand end of the cylindrical casing 3 with a bearing 22** interposed therebetween.

A cylindrical guide case **10*a* is made integral with the right-hand ends of the plate members 18 for the purpose of guiding the slidable displacement of a joint 23 to be described later, and the right-hand end part of the guide case 10*a* is rotatably supported in the rotatable wheel member 17. The left-hand end part of a shaft 24 having a shaft hole 24*a* formed therein in the axial direction is spline-connected to the right-hand part of the guide case 10*a*, and a gear 25 is immovably fitted onto the shaft 24 at the position in the vicinity of the right-hand end of the shaft 24. A hydraulic cylinder 7 serving as an actuator is disposed at the position outside of the bearing portion 13B' of the right-hand supporting plate 13 with the aid of a supporting member 26 in such a manner that the center axis of the hydraulic cylinder 7 is positionally coincident with the center axis of the vibration rolling drum 1. An actuating rod 7*a* projecting outside of the hydraulic cylinder 7 to serve as a thrusting shaft is inserted through the shaft hole 24*a* of the shaft 24, and the joint 23 is disposed on the left-hand end side of the rod 7*a*. The joint 23 is rotatably supported on the rod 7*a* side with the aid of a bearing 27. The right-hand end of a connecting rod 8 is operatively connected to the joint 23, while the left-hand end of the connecting rod 8 is operatively connected to the eccentric weight 6*a*. With such construction, the linear movement of the joint 23 is transformed into the turning movement of the eccentric weight 6*a* about the pivotal shaft 6 via the connecting rod 8**.

A vibration generating hydraulic motor 9 is arranged at the position deviated from the center axis of the vibration rolling drum 1 and located in the vicinity of the right-hand end of the bearing portion 13B' of the right-hand supporting plate 13, with the aid of a supporting member 28. A gear 29 is firmly fitted onto a driving shaft **9*a* of the hydraulic motor 9 to mesh with a gear 25 firmly fitted onto the shaft 24, whereby the driving force generated by the hydraulic motor 9 is transmitted to the shaft 24 via the gears 29 and 25. Consequently, to carry out the present invention, a vibration generating shaft 10 is constructed by a combination made among the shaft 24, the pair of supporting members 18 and the boss member 20. In addition, a variable amplitude type vibrating mechanism 4 is constructed by a combination made among the hydraulic cylinder 7, the rod 7*a*, the joint 23 and the connecting rod 8**.

Incidentally, the first embodiment of the present invention has been described with respect to the case that the hydraulic cylinder 7 is employed as an actuator. However, the present invention should not be limited only to the hydraulic cylinder 7. Alternatively, e.g., an electric motor, a solenoid and other hitherto known actuator may be substituted for the hydraulic cylinder 7.

As is apparent from the above description, since the vibrating mechanism is substantially composed of a vibration generating shaft including a pair of elongated plate-shaped supporting members disposed in the spaced relationship while facing to each other, a movable eccentric weight turnably supported to turn about a pivotal shaft transversely extending at a right angle relative to the center axis of the vibration generating shaft between both the supporting members, and an eccentric weight driving unit for deviating the gravity of the eccentric weight away from the center axis of the vibration generating shaft, and the vibration generating shaft is exposed to the outside with the exception of the supporting members disposed in the opposing relationship. Thus, the eccentric weight can simply be supported and easily assembled in the cylindrical casing.

Especially, in the case of a vibration compacting roller, since the vibration generating shaft has an opened structure, the vibration rolling drum integrated with the cylindrical casing is caused to slowly roll on the ground surface to be compacted therewith while the vibration shaft is received in the cylindrical casing and rotated at a high rotational speed, whereby lubricant falls down from the cylindrical casing in the interior of the vibration generating shaft to reach locations to be lubricated with the lubricant. Thus, these locations can reliably be lubricated with the lubricant.

In contrast with the conventional vibrating mechanism including a plate having a longitudinally extending slot formed therethrough and a driving rod adapted to be slidably thrusted to turn an eccentric weight around a pivotal shaft, in this embodiment, since the eccentric weight is smoothly turned about the pivotal shaft with the aid of the connecting rod, there does not arise a malfunction that the pivotal shaft is rattled in the slot, causing it to wear. Thus, the eccentric weight can exactly be located in the cylindrical casing.

Further, since the vibration generating shaft has an opened structure as mentioned above, a magnitude of inertia moment generated by the eccentric weight can be reduced, a long time is not taken until the rotation of the vibration generating shaft is stopped, and moreover, an amount of energy loss can be reduced.

Incidentally, the first embodiment of the present invention has been described above with respect to the case that the vibrating mechanism is applied to a vibration compacting roller. However, the present invention should not be limited only to this embodiment. Alternatively, the present invention can equally be applied to a vibration utilizing machine such as a vibration type soil compacting machine, a vibration type pile driving machine or a similar machine.

Figure 2:
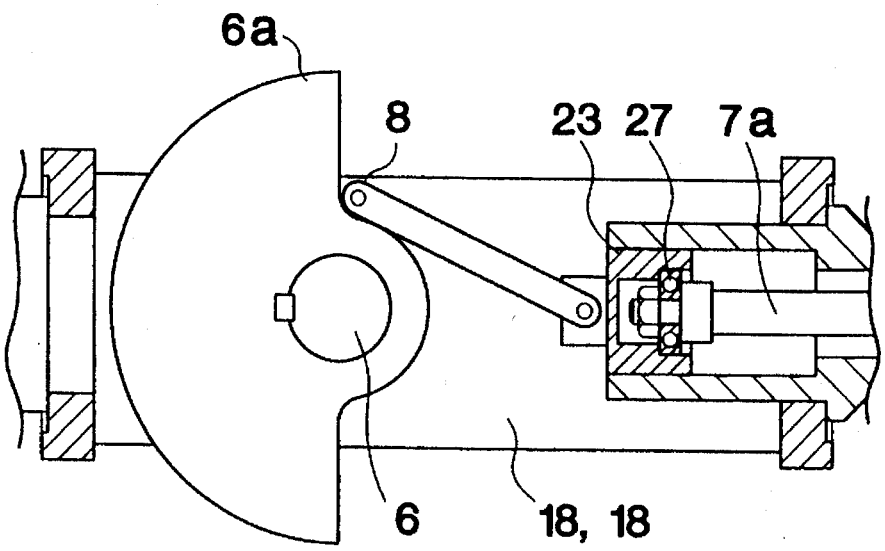
FIG. 2(*a*) and FIG. 2(*b*) are sectional side views which show the structure for variably controlling an amplitude of each vibration induced by an eccentric weight used for the vibrating mechanism shown in FIG. 1, respectively.
Figure 2:
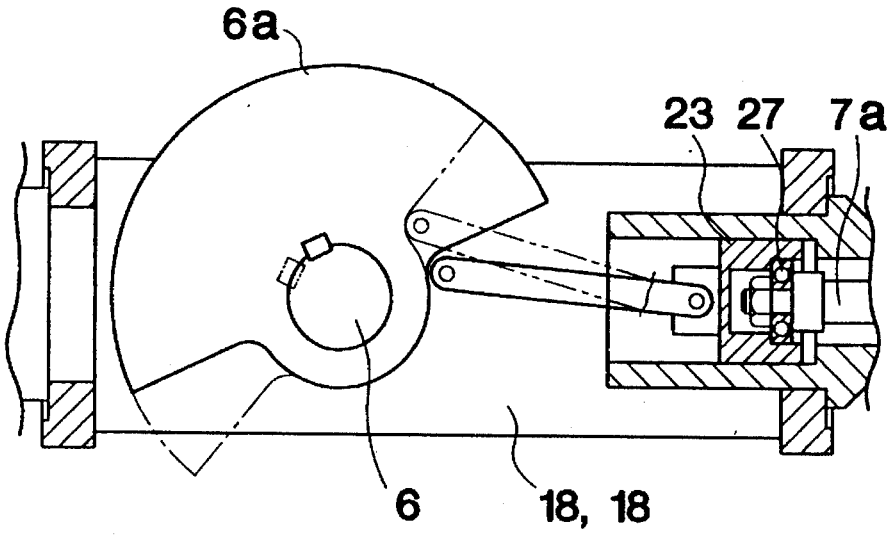

When the vibration compacting roller is to be released from the vibrating state, the rod 7*a* of the hydraulic cylinder 7 is expanded as shown in FIG. 2(*a*) until the gravity center of the eccentric weight 6*a* positionally coincides with the center axis of the vibration generating shaft 10, causing the eccentric weight 6*a* to exhibit an upright standing attitude. At this time, the dead weight of the eccentric weight 6*a* is distributed uniformly on the opposite sides relative to the center axis of the vibration generating shaft 10. With this construction, the vibration of the vibration rolling drum 1 can be stopped even though the vibration generating shaft 10 is continuously rotated. On the other hand, when the vibration compacting roller is to be brought in the vibrating state while the vibration generating shaft 10 is continuously rotated, the rod 7*a* of the hydraulic cylinder 7 is retractively contracted so that the eccentric weight 6*a* is displaced to the one side away from the center axis of the vibration generating shaft 6*a* as shown in FIG. 2(*b*), causing the eccentric weight 6*a* to be turned about the pivotal shaft 6, whereby the gravity center of the eccentric weight 6*a* is deviated away from the center axis of the vibration generating shaft 10.

In this case, when the operative state of the eccentric weight 6*a* is changed from the state that the gravity center of the eccentric weight 6*a* is located on the center axis of the vibration generating shaft 10 as shown in FIG. 2(*a*) to the state that the eccentric weight 6*a* is turned about the pivotal shaft 6 by an angle of about 90 degrees as represented by solid lines in FIG. 2(*b*), the gravity center of the eccentric weight 6 is largely deviated away from the center axis of the vibration generating shaft 10, resulting in the operative state represented by a high amplitude (H) being selectively taken. Similarly, when the eccentric weight 6*a* is turned about the pivotal shaft 6 by an angle of about 45 degrees to assume the operative state as represented by phantom lines in FIG. 2(*b*), the gravity center of the eccentric weight 6*a* is deviated away from the center axis of the vibration generating weight 10 to a small extent, resulting in the operative state represented by a low amplitude (L) being selectively taken. The changing of the operative state from the high vibration amplitude state to the low vibration amplitude state, and vice versa is executed by a vibration amplitude changing switch 43 for actuating a variable amplitude controlling unit 40 shown in FIG. 3 and FIG. 4.

Figure 3:
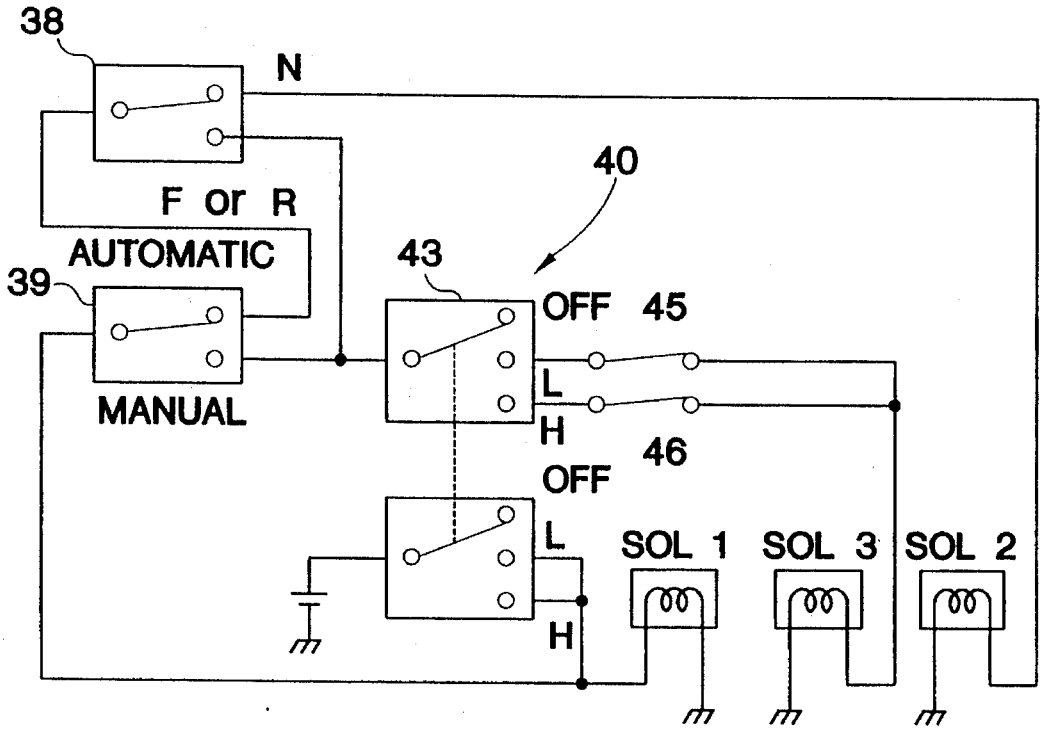
FIG. 3 is a signal circuit diagram which illustrates signal circuits usable for a vibration generating apparatus including the vibrating mechanism constructed in accordance with each of the first and second embodiments of the present invention.
Figure 4:
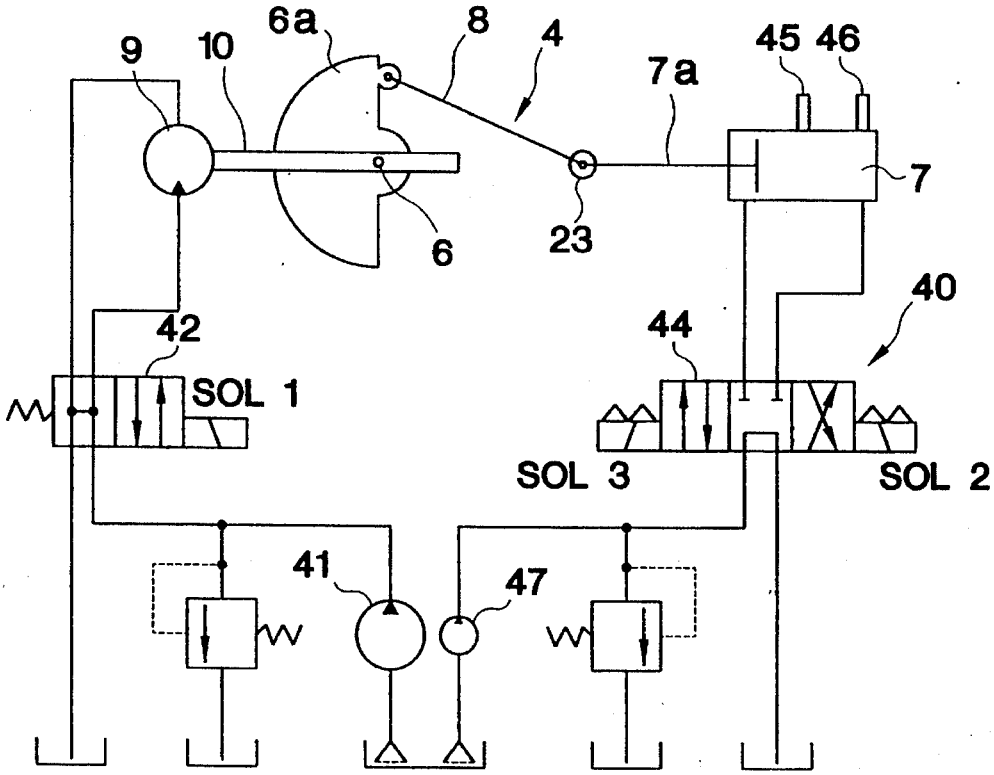
FIG. 4 is a hydraulic circuit diagram which illustrates hydraulic circuits usable for the foregoing vibration generating apparatus constructed in accordance with each of the first and second embodiments of the present invention.

Referring to FIG. 3 that is a signal circuit diagram and FIG. 4 that is a hydraulic circuit diagram, the variable amplitude controlling unit 40 is substantially composed of a hydraulic pump 47, a hydraulic cylinder 7 arranged along the center axis of the vibration generating shaft 10, a joint 23 rotatably disposed in a main body of the hydraulic cylinder 7 to rotate about the center axis of a rod 7*a*, a connecting rod 8 of which one end is operatively connected to the joint 23 side and of which other side is operatively connected to the eccentric weight 6*a* side, and a solenoid driven change valve 44 disposed in a hydraulic circuit to supply pressurized hydraulic oil from a hydraulic pump 47 to the hydraulic cylinder 7.

Referring to FIG. 3 and FIG. 4 again, a solenoid driven change valve 42 operatively associated with the vibration amplitude changing switch 43 serving as vibration mode setting means for activating the solenoid driven change valve 42 is disposed in the form of a solenoid valve in a hydraulic oil supplying circuit hydraulically connected to the hydraulic pump 41 for supplying pressurized hydraulic oil to a vibration generating hydraulic motor 9. While the vibration amplitude changing switch 43 is set to the state represented by a low amplitude (L) or a high amplitude (H), a signal is normally fed to a solenoid coil SOL1 of the solenoid driven change valve 42 designed in the form of a solenoid valve in order to rotate the vibration generating hydraulic motor 9. Thus, as the vibration generating hydraulic motor 9 is rotated, the vibration generating shaft 10 is rotated in a predetermined direction.

On the other hand, to deviate the gravity center of the eccentric weight 6*a* away from the center axis of the vibration generating shaft 10, another solenoid driven change valve 44 is disposed in the hydraulic circuit for supplying pressurized hydraulic oil from the hydraulic pump 47 to the hydraulic cylinder 7. When the inoperative state represented by a neutral position (N) of the forward/rearward movement lever 130 is detected by a neutral position detecting switch 38, electric current is fed to a solenoid coil SOL2 of the solenoid driven change valve 44 so as to allow the rod 7*a* of the hydraulic cylinder 7 to be expanded. Consequently, the eccentric weight 6*a* is held in the upright standing state as shown in FIG. 2(*a*) so that the gravity center of the eccentric weight 6*a* is located on the center axis of the vibration generating shaft 10.

When a forward movement position (F) or a rearward movement position (R) of the forward/rearward movement lever 130 is detected by the neutral position detecting switch 38 while the vibration amplitude changing switch 43 is actuated to the position corresponding to the operative state represented by a low amplitude (L) or a high amplitude (H), electric current is fed to a solenoid coil SOL3 of the solenoid driven change valve 44, causing the rod 7*a* of the hydraulic cylinder 7 to be retractively contracted. Thus, the eccentric weight 6*a* is turnably displaced to assume the state as shown in FIG. 2(*b*) so that the gravity center of the eccentric weight 6*a* is deviated away from the center axis of the vibration generating shaft 10.

For example, when the vibration amplitude changing switch 43 is actuated to assume the operative state represented by a low amplitude (L), a L position sensor 45 disposed at the substantially intermediate position of the main body of the hydraulic cylinder 7 to serve as an eccentricity quantity detecting sensor operatively associated with the eccentric weight eccentricity quantity detecting unit allows the rod 7*a* of the hydraulic cylinder 7 to be retractively contracted to a predetermined intermediate position so that the feeding of electric current to the solenoid coil SOL3 of the solenoid driven change valve 44 is interrupted. Subsequently, the solenoid driven change valve 44 is displaced to the neutral position so that the supplying of pressurized hydraulic oil to the hydraulic cylinder 7 is stopped, and at the same time, the retractive contracting operation of the hydraulic cylinder 7 is stopped. Consequently, the eccentric weight 6*a* is held in the operative state represented by phantom lines in FIG. 2(*b*). At this time, since the gravity center of the eccentric weight 6*a* is deviated away from the center axis of the vibration generating shaft 10 to a small extent, an amplitude of each vibration generated by the vibration generating shaft 10 is suppressively reduced. On the contrary, when the vibration amplitude changing switch 43 is actuated to assume the operative state represented by a high amplitude (H), a H position sensor 46 likewise serving as an eccentricity detecting sensor stops the feeding of electric current to the solenoid coil SOL3 of the solenoid driven change valve 44. Subsequently, the solenoid driven change valve 44 is displaced to the neutral position so that the supplying of pressurized hydraulic oil to the hydraulic cylinder 7 is stopped, and the retractive contracting operation of the rod 7*a* of the hydraulic cylinder 7 is stopped. Consequently, while the operative state of the eccentric weight 6*a* largely deviated from the center axis of the vibration generating shaft 120 as represented by solid lines in FIG. 2(*b*) is maintained, the eccentric weight 6*a* is turned further to generate vibrations each having a high amplitude. In FIG. 3, reference numeral 39 designates an automatic/manual changing switch adapted to be actuated to one of the automatic side and the manual side.

In this embodiment, two position sensors 45 and 46 each designed in the form of reed switch adapted to be magnetically actuated to serve as eccentric weight eccentricity quantity detecting means are disposed at two locations on the main body of the hydraulic cylinder 7. Normally, each reed switch is turned on but when a magnetic ring disposed in the vicinity of the rod 7*a* of the hydraulic cylinder 7 comes near to the reed switch, the latter is turned off. This enables the extent of expansion of the rod 7*a* of the hydraulic cylinder 7 to be detected. Since the sensors 45 and 46 as mentioned above are disposed on the main body of the hydraulic cylinder 7, signal lines can be drawn directly from the sensors 45 and 46 without any passing through the narrow space of the vibrating mechanism filled with a vapor of lubricant, resulting in reliability of the vibration generating apparatus being substantially improved.

As described above, the eccentric weight eccentricity detecting unit includes a plurality of eccentric weight eccentricity quantity detecting sensors each adapted to be activated when a movable portion (rod 7*a*) of the hydraulic cylinder 7 is displaced to a predetermined position while they are electrically connected to the solenoid coil SOL3 of the solenoid driven change valve 44 disposed on the side where the hydraulic cylinder 7 is actuated in such a manner as to increase a quantity of eccentricity of the vibration generating shaft 10. Incidentally, the foregoing embodiment has been described above with respect to the case that two eccentric weight eccentricity quantity detecting sensors are disposed on the main body of the hydraulic cylinder to detect vibrations each having a high amplitude or a low amplitude. When an increased number of sensors are disposed on the main body of the hydraulic cylinder 7 and the vibration amplitude changing switch 43 is actuated to the opposite side having the corresponding number of contacts formed thereon, a rotational angle of the eccentric weight 6*a* can finely be changed by way of many steps. This leads to the result that a vibration generating apparatus can be realized for the vibration compacting roller in such a manner as to allow an amplitude of each vibration generated by the vibration generating shaft 10 to be changed by way of the increased number of steps.

Next, a mode of operation of the vibration generating apparatus for the vibration compacting roller constructed in accordance with the first embodiment of the present invention above will be described below. Before a road surface compacting operation starts to be performed, first, an operator sitting on his seat actuates the forward/rearward movement lever 130 to be located at the neutral position B, and subsequently, he actuates the vibration amplitude changing switch 43 so as to allow the inoperative state of the vibration generating apparatus to be changed to the operative state represented by a low amplitude (L) or a high amplitude (H), whereby electric current is fed to the solenoid coil SOL1 of the solenoid driven change valve 42 so that pressurized hydraulic oil is supplied from the hydraulic pump 41 to the vibration generating hydraulic motor 9 which in turn is rotated to thereby rotate the vibration generating shaft 10 in a predetermined direction. Since the forward/rearward movement lever 130 is located at the neutral position B while the foregoing state is maintained, the neutral position detecting limit switch 38 sends to the solenoid coil SOL2 of the solenoid driven change valve 44 a signal instructing that the forward/rearward movement lever 130 is located at the neutral position B, whereby the rod 7*a* of the hydraulic cylinder 7 is expanded so as to allow the gravity center of the eccentric weight 6*a* to be located on the center axis of the vibration generating shaft 10, resulting in an intensity of vibration generating force being reduced to a level of zero.

Subsequently, when the forward/rearward movement lever 130 is displaced from the neutral position B to the forward movement position A while the vibration amplitude changing switch 43 is actuated to the position corresponding to the operative state represented by a high amplitude (H), the neutral position detecting limit witch 138 does not feed an electric current to the solenoid coil SOL2 of the solenoid driven change valve 44 but feeds an electric current the solenoid coil SOL3 of the solenoid driven change valve 44, whereby the gravity center of the eccentric weight 6*a* is largely deviated away from the center axis of the vibration generating shaft 10. While the foregoing state is maintained, the vibration generating shaft 10 is rotated so as to allow the vibration generating apparatus to generate vibrations each having a high amplitude.

When the forward/rearward movement lever 130 is to be displaced to the rearward movement position C after a road surface compacting operation is achieved by a predetermined distance with the forward/rearward movement lever 130 located at the forward movement position A, it is once restored to the neutral position B. At this time, since the vibration amplitude changing switch 43 is changeably actuated to assume the operative state represented by a high amplitude (H), the vibration generating shaft 10 is continuously rotated. Subsequently, as the forward/rearward movement lever 130 is displaced to the neutral position B, the neutral position detecting limit switch 38 feeds electric current to the solenoid coil SOL2 of the solenoid driven change valve 44 but not to the solenoid coil SOL3 of the same, whereby the rod 7*a* of the hydraulic cylinder 7 is expanded until the gravity center of the eccentric weight 6*a* is located on the center axis of the vibration generating shaft 10. Thus, the vibration generating shaft 10 is continuously rotated while an amplitude of each vibration is reduced to a level of zero. Thereafter, when the forward/rearward movement lever 130 is displaced to the rearward movement position C, the vibration rolling drum 1 is rotated with a high amplitude in the same manner as when the forward/rearward movement lever 130 is displaced to the forward movement position A.

In the case that the vibration amplitude changing switch 43 is changeably actuated from the operative state represented by a high amplitude (H) to the operative state represented by a low amplitude (L) in the course of each road surface compacting operation, the forward/rearward movement lever 130 is once restored to the neutral position B, and thereafter, the vibration amplitude changing switch 43 is changeably actuated to the opposite side. Subsequently, when the forward/rearward movement lever 130 is displaced to the forward movement position A or the rearward movement position B, the neutral position detecting limit switch 138 does not feed electric current to the solenoid coil SOL2 of the solenoid driven change valve 44 but it feeds electric current to the solenoid coil SOL3 of the same, whereby the gravity center of the eccentric weight 6*a* is deviated away from the center axis of the vibration generating shaft 10 to a small extent, resulting in the vibration generating apparatus generating vibrations each having a low amplitude.

In this embodiment, since the vibration generating apparatus includes as essential components an eccentricity signal generating unit for generating a signal for deviating the gravity center of the eccentric weight away from the center axis of the vibration generating shaft, an eccentric weight eccentricity quantity detecting unit for detecting a quantity of eccentricity of the eccentric weight, and an eccentric weight eccentricity quantity controlling unit for controlling a quantity of eccentricity of the vibration generating shaft with the aid of a vibration mode setting unit for setting an applicable vibration mode and the eccentric weight eccentricity quantity detecting unit in response to a signal transmitted from the eccentricity signal generating unit. With this construction, it is not necessary that the direction of rotation of the vibration generating shaft is changed to the opposite one every time the vibration mode is changed to another one. In contrast with the conventional vibration generating apparatus of the type wherein an amplitude of each vibration is changed to another one by changing the direction of rotation of the vibration generating shaft to the opposite one, there is no possibility that components associated with the vibration generating shaft are damaged or injured when the eccentric weight intensely collides against an engagement portion of the stationary eccentric weight. In addition, no energy is lost when the amplitude of each vibration is changed to another one. Since a quantity of eccentricity of the eccentric weight can automatically be changed to another one in such a manner as to allow the present amplitude of each vibration to match with the selected vibration mode, a desired amplitude of each vibration can simply be determined in contrast with the conventional vibration generating apparatus adapted to change an amplitude of each vibration to another one without any changing of the direction of rotation of the vibration generating shaft to the opposite side.

In this embodiment, when the forward/rearward movement lever 130 is displaced from the forward movement position to the rearward movement position via the neutral position, and vice versa, the rod 7*a* of the hydraulic cylinder 7 held in the retractive contracted state is once expanded to locate the gravity center of the eccentric weight 6*a* on the center axis of the vibration generating shaft 10, and subsequently, after the forward/rearward movement lever 130 is displaced to the forward movement position A or the rearward movement position C, the rod 7*a* of the hydraulic cylinder 7 is retractively contracted so as to allow the center axis of the eccentric weight 6*a* to be deviated away from the center axis of the vibration generating shaft 10 to thereby generate vibrations with the aid of the eccentric weight 6*a* and the vibration generating shaft 10. At this time, there may arise a malfunction that vibrations generated by the vibration generating shaft 10 do not correctly match with the running state of the vibration compacting roller because of some time lag appearing between the running of the vibration compacting roller in the forward/rearward direction and the expansion or contraction of the rod 7*a* of the hydraulic cylinder 7 achieved by the forward/rearward movement lever 130. To cope with the foregoing malfunction, it is acceptable that the range of detecting the neutral position B on the cam 136 is widened or a hitherto known adequate sequence controlling unit is arranged in a controller(not shown) for the vibration generating apparatus to properly control the running state of the vibration compacting roller in the forward/rearward movement and the expansion or contraction of the rod 7*a* of the hydraulic cylinder 7 in order to assure that the vibration compacting roller can more correctly run without an occurrence of resonance.

Figure 5:
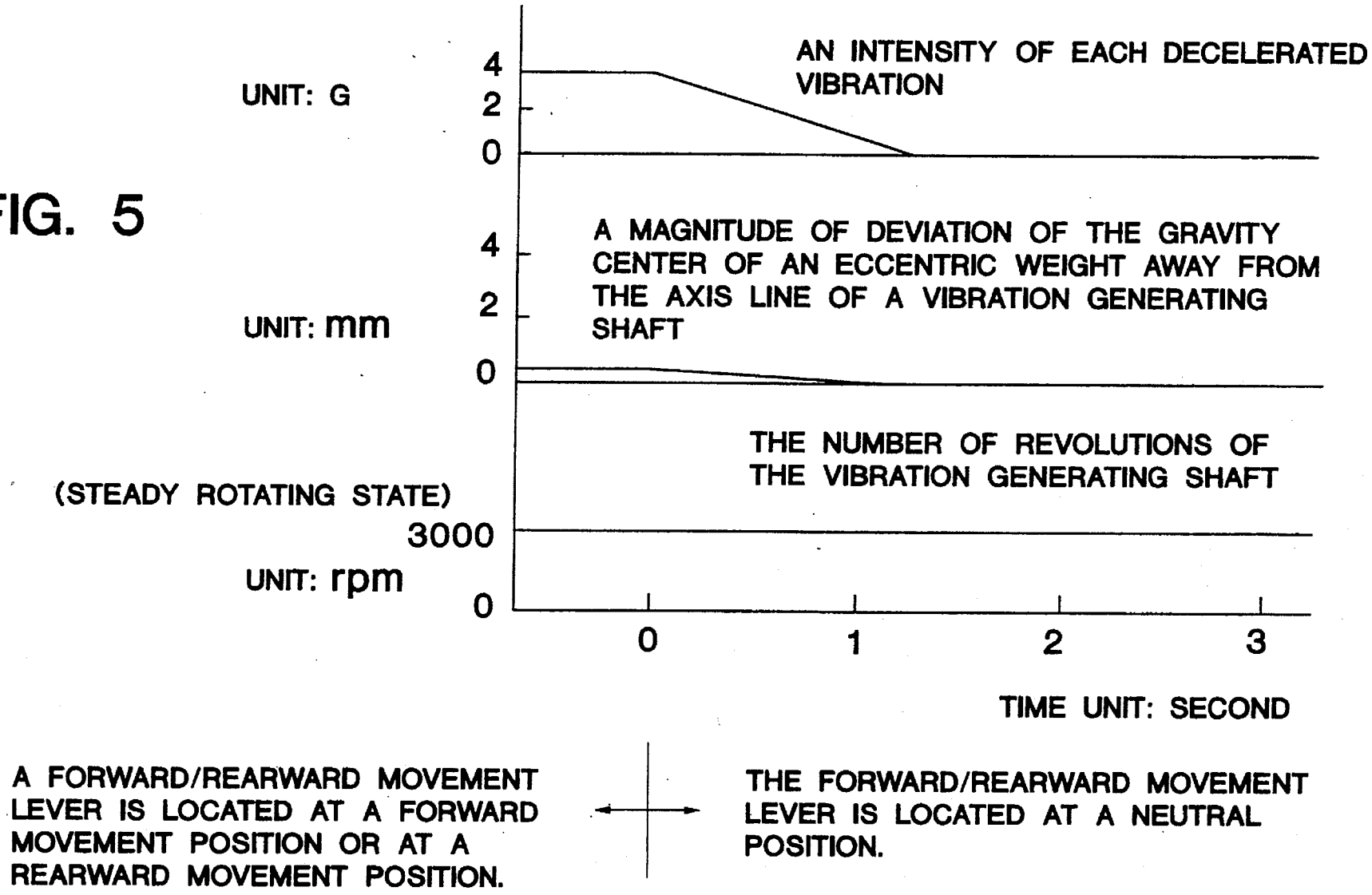
FIG. 5 is a graph which illustrates how the relationship among the number of revolutions of a vibration generating shaft, a magnitude of deviation of the center axis of a rolling drum from the center axis of a vibration compacting roller and an amplitude of decelerated vibration varies as time elapses under condition that a forward/rearward movement lever is actuated from a forward movement position or a rearward movement position to a neutral position while the vibration generating shaft disposed in the vibrating mechanism constructed in accordance with the first embodiment of the present invention is steadily rotated.
Figure 13:
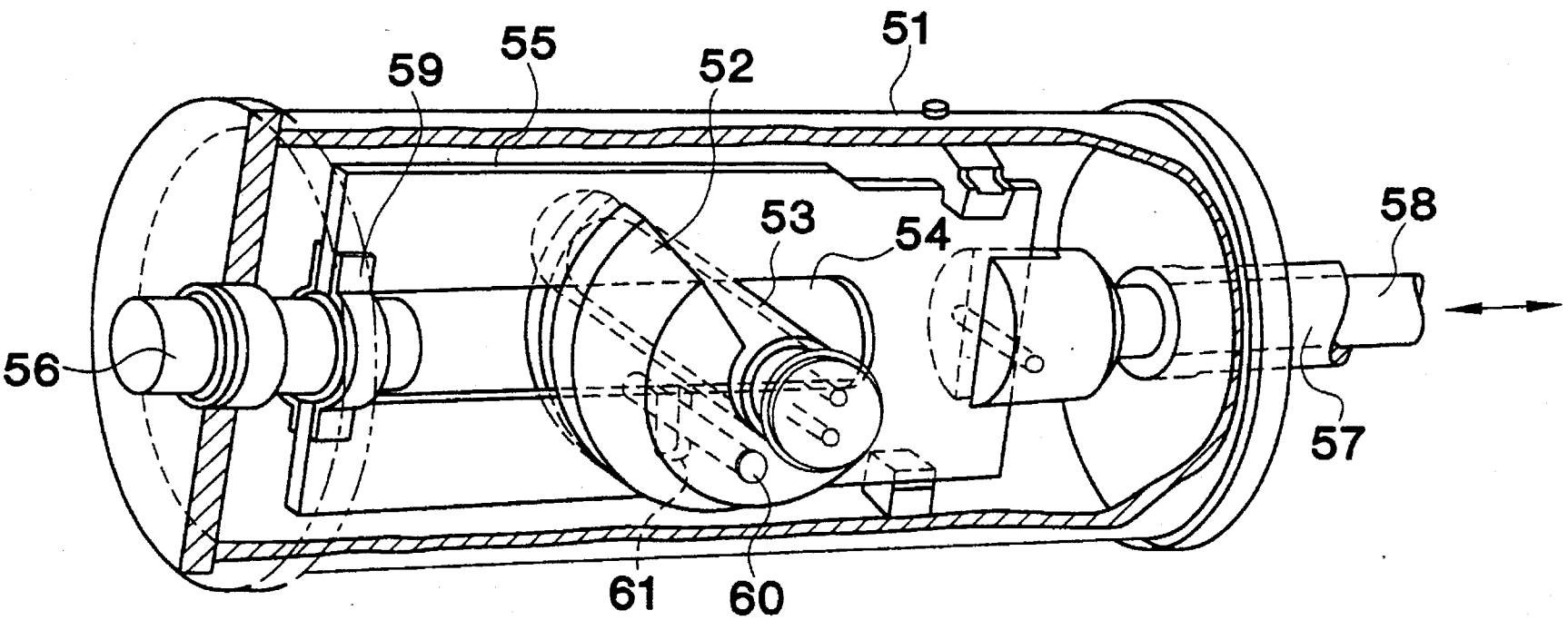
FIG. 13 is a perspective view which shows the structure of the conventional vibrating mechanism while the latter is largely exploded on the front side in the axial direction.

FIG. 5 is a graph which illustrates how the relationship among the number of revolutions of the vibration generating shaft 10, a magnitude of deviation of the gravity center of the eccentric weight 6*a* away from the center axis of the vibration generating shaft 10 and an intensity of each decelerated vibration varies when the forward/rearward movement lever 130 is displaced from the forward movement position A or the rearward movement position B to the neutral position C while the vibration generating shaft 10 is steadily rotated. As is apparent from the drawing, since a magnitude of deviation of the gravity center of the eccentric weight 6*a* away from the center axis of the vibration generating shaft 10 is gradually reduced from the point of time when the forward/rearward movement lever 130 is displaced to the neutral position B, any occurrence of resonance is not recognized in the contract with the properties of the conventional generating apparatus as shown in FIG. 13. This is attributable to the fact that in response to a signal transmitted from the neutral signal detecting unit 170 to instruct that the neutral position of the forward/rearward movement lever 130 is detected by the neutral position detecting unit 170, the gravity center of the eccentric weight 6*a* is located on the center axis of the vibration generating shaft 10. As is apparent from the graph shown in FIG. 5, when a period of 1.3 seconds elapse after the forward/rearward movement lever 130 is displaced at the neutral position B, a magnitude of deviation of the gravity center of the eccentric weight 6*a* away from the center axis of the vibration generating shaft 10 and an intensity of decelerated vibration are reduced to a level of zero, resulting in the vibrative movement of the vibration rolling drum 1 being stopped. FIG. 5 diagrammatically illustrates by way of example the ideal case that the gravity center of the eccentric weight 6*a* completely coincides with the center axis of the vibration generating shaft 10 when the forward/rearward movement lever 130 is located at the neutral position B. With such construction, in many cases, the vibration generating apparatus exhibits the same pattern as mentioned above in such a manner that a magnitude of deviation of the gravity center of the eccentric weight 6*a* away from the center axis of the vibration generating shaft 10 and an intensity of decelerated vibration are increasingly reduced toward a level of zero without an occurrence of resonance. In this connection, there often arises an occasion that the gravity center of the eccentric weight 6*a* does not completely coincide with the center axis of the vibration generating shaft 10 due to machining error or a similar factor. At this time, the vibration rolling drum 1 is continuously vibrated with a small amplitude for a period of several seconds. In practice, however, the vibration of the vibration rolling drum 1 with a small amplitude in that way has few effect on lowering of the compacted road surface or the like. Consequently, while the foregoing state is maintained, the vibrating compacting roller is brought in the vibration stopped state. In other words, as long as the gravity center of the eccentric weight 6*a* is located substantially on the center axis of the vibration generating shaft 10, it is assumed that the vibration compacting roller is held in the vibration stopped state.

As is apparent from the above description, in response to a signal transmitted from the forward/rearward movement lever neutral position detecting unit 170 to instruct that the forward/rearward movement lever 130 is displaced to the neutral position B, the gravity center of the eccentric weight 6*a* is located substantially on the center axis of the vibration generating shaft 10. Thus, when the running of the vibration compacting roller is stopped, the vibration rolling drum 1 is brought to rest in the non-vibrating state without any occurrence of resonance.

The shown embodiment has been described with respect to the case that the vibration generating shaft 10 is steadily rotated while the forward/rearward movement lever 130 is locates at the neutral position. The above mentioned example was the case that the vibration generating shaft 10 was kept in its constant speed of revolution when the forward/rearward movement lever 130 was operated to the neutral position. But, even if the speed of revolution of the vibration generating shaft gradually decreases and passes through the resonance point of vibration and the vibrating generating shaft is topped, the vibration of the vibration rolling drum can be stopped without occurrence of resonance, providing that the gravity center of the vibrating generating shaft is substantially located on the center axis of the vibrating generating shaft before passing through the resonance point in response to a neutral signal transmitted from the forward/rearward movement lever neutral location detecting unit 170.

Similarly, when the forward/rearward movement lever 130 is displaced from the neutral position B to the forward movement position A or the rearward movement position C, the vibration rolling drum 1 can start to be vibratively rotated without any occurrence of resonance from the inoperative state that the vibration rolling drum 1 is held in the vibration stopped state, as soon as the vibration compacting roller starts to run, provided that the vibration generating shaft 10 is continuously rotated in the steady state. Also in the case that while the running of the vibration compacting roller is stopped, the gravity center of the eccentric weight 6*a* is located substantially on the center axis of the vibration generating shaft 10, and at the same time, the number of revolutions of the vibration generating shaft 10 is gradually increased from the inoperative state that the vibration generating shaft 10 is held in the vibration stopped state, the vibration rolling drum 1 can start to be vibratively rotated without any occurrence of resonance, provided that the gravity center of the eccentric weight 6*a* is located substantially on the center axis of the vibration generating shaft 10 when the number of revolutions of the vibration rolling drum 1 coincides with the foregoing resonance point.

To assure that the gravity center of the eccentric weight 6*a* is located substantially on the center axis of the vibration generating shaft 10 on an occurrence of resonance without fail, it advantageously acceptable that a measure is taken such that the range of detecting the neutral position B on the cam 136 is widened or a hitherto known adequate sequence controlling unit is arranged in the vibration generating apparatus for the purpose of changing the number of revolutions of the vibration generating shaft 10 to another one and/or advancing or delaying the timing for changing a quantity of eccentricity of the eccentric weight 6*a* to another one after the neutral position B is detected. With this construction, the vibration generating apparatus can be operated more reliably.

In this case, when the vibration rolling drum 1 is brought in the vibration stopped state by locating the gravity center of the eccentric weight 6*a* substantially on the center axis of the vibration generating shaft 10 without any stopping of rotation of the vibration generating shaft 10, a magnitude of load to be borne by each of the hydraulic pumps 41 and 47 and the vibration generating hydraulic motor 9 can be reduced with a reduced quantity of energy loss induced attributable to the stopping of the rotation of the vibration generating shaft 10. Especially, when the vibration compacting roller performs a given rolling operation while maintaining the number of revolutions of the vibration generating shaft 10 in the steady rotating state, a quantity of energy loss induced by the stopping of rotation of the vibration generating shaft 10 can be minimized.

On an occurrence of resonance, the number of revolutions of the vibration generating shaft 10 is usually smaller than the number of revolutions of the vibration generating shaft 10 in the steady operative state of the latter. For this reason, it is recommendable that a measure is taken such that in response to a signal transmitted from the forward/rearward movement lever neutral position detecting unit 170 to instruct that the forward/rearward movement lever 130 is located at the neutral position B, the number of revolutions of the vibration generating shaft 10 is maintained at a value corresponding to the number of revolutions of the vibration generating shaft 10 in the steady rotating state or a value in excess of a predetermined value (i.e., a value larger than the number of revolution of the vibration generating shaft 10 approximately corresponding to the resonance point). When this measure is taken, there does not arise a malfunction that the operative state of the vibration rolling drum 1 coincides with the resonance point even though the vibration generating shaft 10 is fabricated with some slightly large machining error, causing the gravity center of the eccentric weight 6*a* to be slightly deviated away from the center axis of the vibration generating shaft 10. Consequently, the vibration generating apparatus can advantageously be operated for the vibration compacting roller without any occurrence of resonance.

Figure 9:
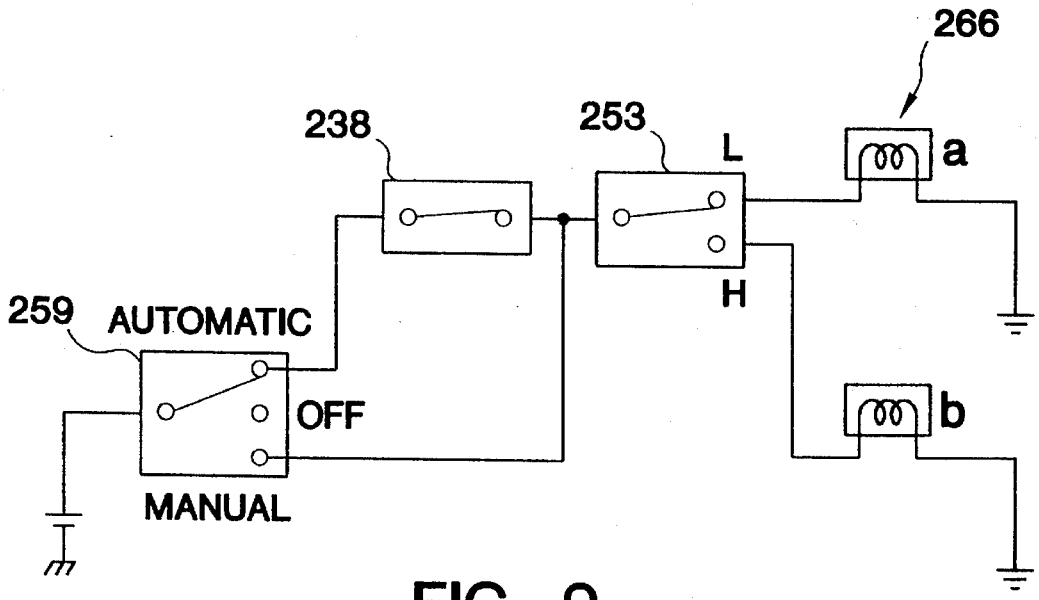
FIG. 9 is a signal circuit diagram which illustrates signal circuits used in the conventional vibration generating apparatus.
Figure 10:
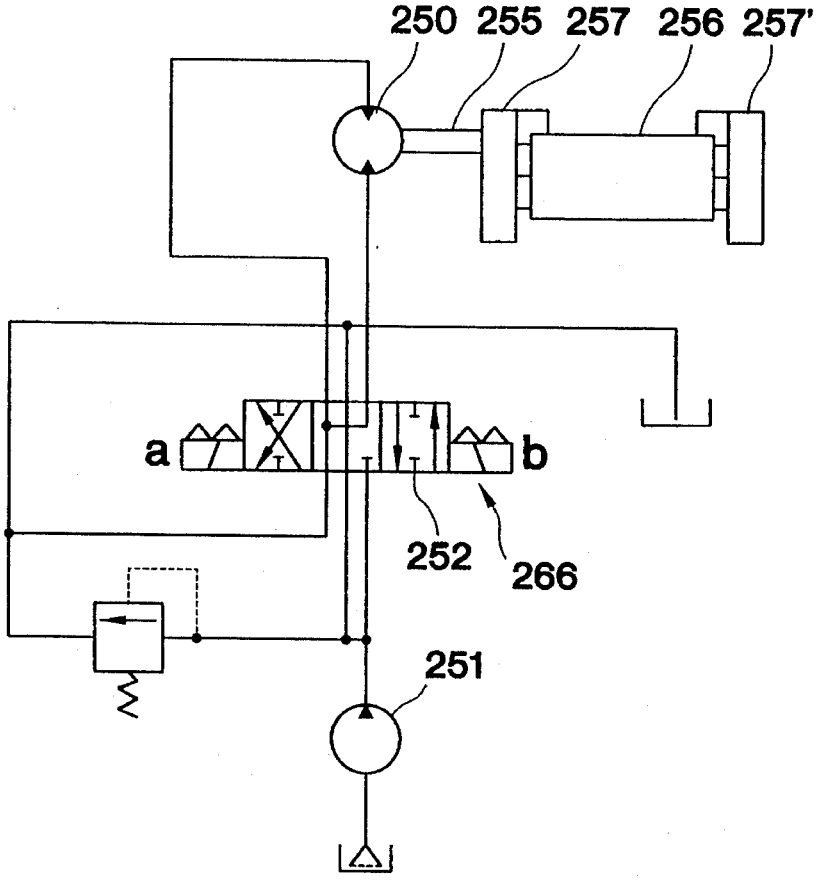
FIG. 10 is a hydraulic circuit diagram which illustrates hydraulic circuits used in the conventional vibration generating apparatus.
Figure 12:
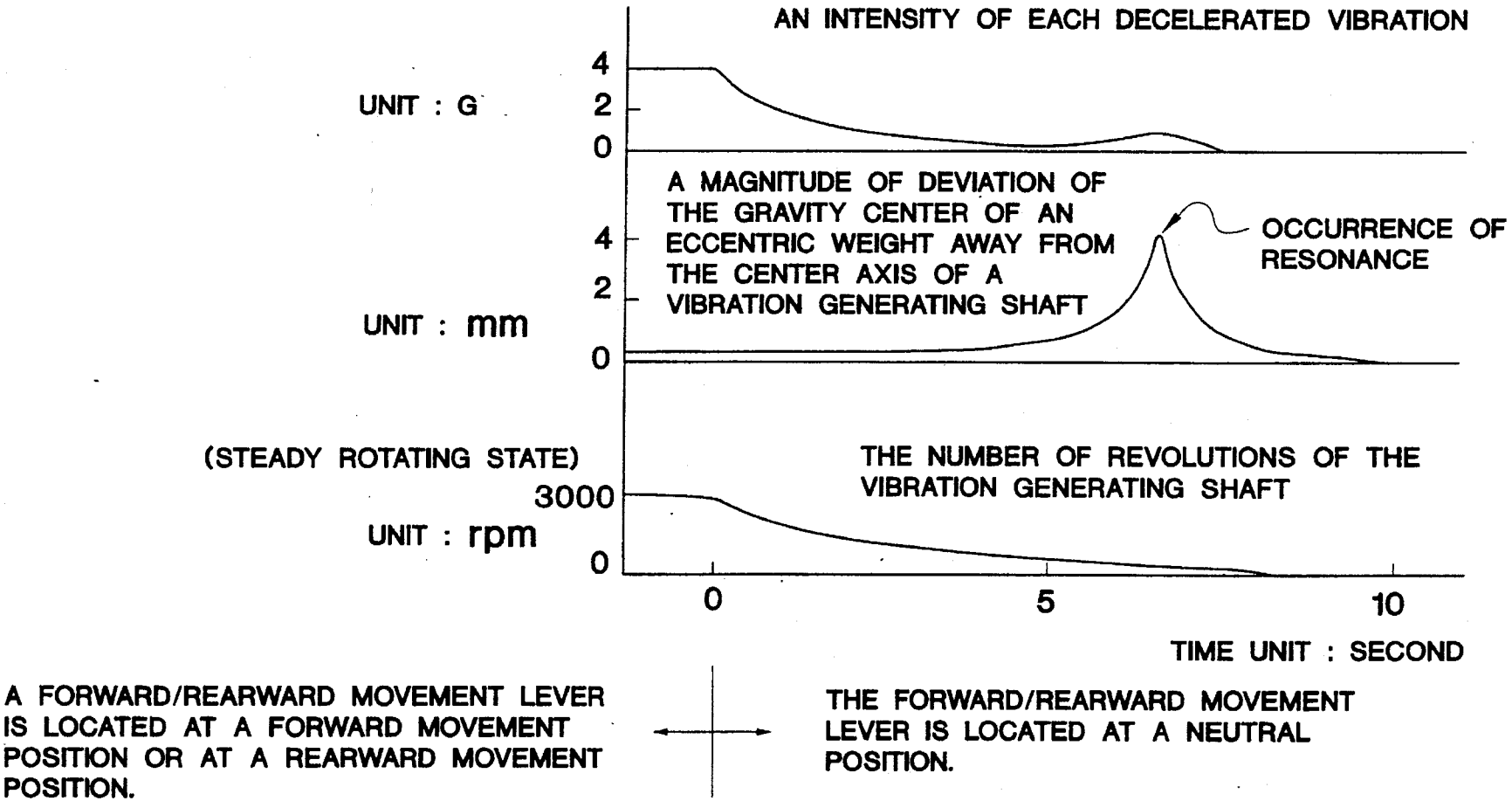
FIG. 12 is a graph which illustrates how the relationship among the number of revolutions of a vibration generating shaft disposed in the conventional vibrating mechanism, a magnitude of deviation of the center axis of a vibration rolling drum from that of a vibration compacting roller and an amplitude of each decelerated vibration varies until the rotation of the vibration generating shaft is stopped under a condition that a forward/rearward movement lever is actuated from a forward movement position or a rearward movement position to a neutral position while the vibration generating shaft is steadily rotated.

Next, a vibration generating apparatus constructed in accordance with a second embodiment of the present invention will be described below with reference to FIG. 4 and FIG. 6. In this embodiment, since a vibrating mechanism used for the vibration generating apparatus is constructed in the same manner as the preceding embodiment, repeated description on the structure of the vibrating mechanism is herein omitted for the purpose of simplification. In addition, the structure of the vibration generating apparatus constructed in accordance with the second embodiment of the present invention is substantially same to that shown in four drawings, i.e., FIG. 1 which shows the structure of the vibrating mechanism for a variable amplitude type vibration compacting roller, FIG. 2 which shows the operative state of an eccentric weight in the vibration generating apparatus, FIG. 9 which shows hydraulic circuits for the vibration generating apparatus, and FIG. 8 which shows a forward/rearward movement lever and a hydraulic pump arranged for drivably running the vibration compacting roller. However, in the second embodiment, since a signal transmitted from a forward/rearward movement lever neutral position detecting unit is not used for an eccentricity signal generating unit but a signal transmitted from a vibration compacting roller driving system is used in operative association with a running speed detecting unit, the neutral position detecting limit switch 138 shown in FIG. 8 is not required. For this reason, the vibration generating apparatus can more simply be constructed in accordance with the second embodiment of the present invention in contrast with the conventional vibration generating apparatus. Now, the structure of the vibration generating apparatus constructed in accordance with the second embodiment of the present invention will be described hereinafter mainly with respect to components other than those shown in FIG. 1, FIG. 2, FIG. 4 and FIG. 8.

Figure 6:
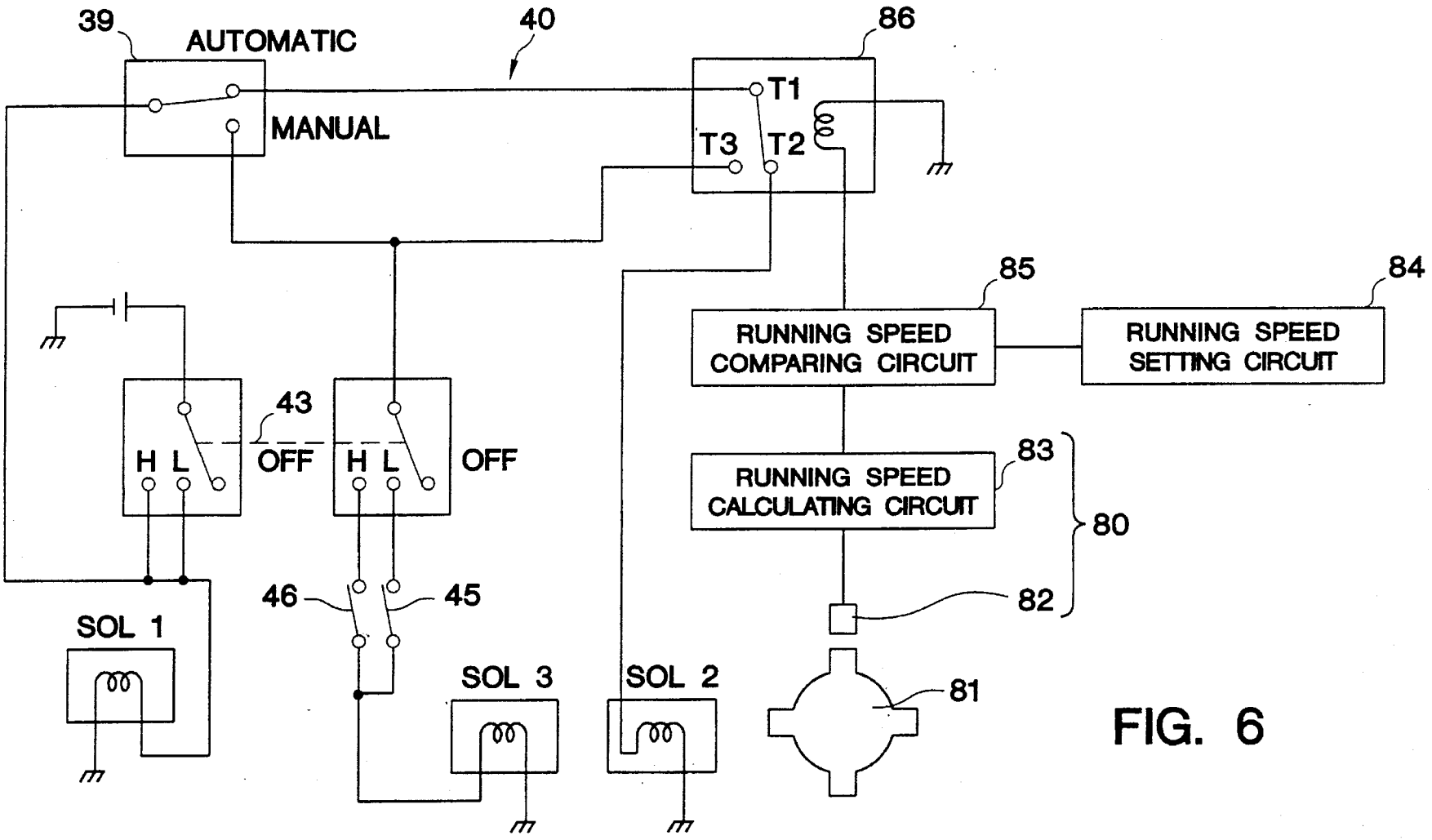
FIG. 6 is a signal circuit diagram which illustrates signal circuits usable for a vibration generating apparatus constructed in accordance with the second embodiment of the present invention.

FIG. 6 is a signal circuit diagram which is used for the vibration generating apparatus constructed in accordance with the second embodiment of the present invention. This signal circuit diagram shows that a member 81 such as a gear or the like disposed in a vibration compacting roller driving system, a running speed sensor 82 disposed in the vicinity of the member 81 in the form of a proximity sensor or the like to serve as running speed detecting means, a running speed calculating circuit 83, a running speed setting circuit 84 to serve as running speed setting means, and a running speed comparing circuit 85 to serve as running speed comparing means are arranged for the vibration generating apparatus. When the running speed of the vibration compacting roller is detected by the running speed sensor 82 and then calculated by the running speed calculating circuit 83, the running speed comparing circuit 85 comparatively determines a difference between the present running speed of the vibration compacting roller and a predetermined running speed of the same preset by the running speed setting circuit 84. In other words, it is comparatively determined by the running speed comparing circuit 85 whether or not the present running speed of the vibration compacting roller is higher than the foregoing predetermined running speed. In response a signal transmitted from the running speed comparing circuit 85, an eccentric weight eccentricity quantity determining controlling unit 40 is activated for the vibration generating apparatus. It should be noted that the running speed of the vibration compacting roller compared in the running speed comparing circuit 85 is usually represented by an absolute value.

Specifically, when the running speed of the vibration compacting roller detected by the running speed detecting sensor 82 is lower than the running speed of the same preset by the running speed setting circuit 84, electric current is fed from the running speed comparing circuit 85 to the relay 86 so that a contact $T_1$ and a contact $T_2$ in the relay 86 are electrically connected to each other. Thus, electric current is fed to the solenoid coil SOL2 of the solenoid driven change valve 44 shown in FIG. 44, causing the solenoid driven change valve 44 shown in FIG. 4 to be activated in such a manner as to allow the rod 7*a* of the hydraulic cylinder 7 to be expanded. When the eccentric weight 6*a* is held in the upright standing state shown in FIG. 2(*a*), the gravity center of the eccentric weight 6*a* is located on the center axis of the vibration generating shaft 10. In other words, when the running speed of the vibration compacting roller detected by the running speed detecting sensor 82 is lower than the running speed of the same set by the running speed setting circuit 84, the gravity center of the eccentric weight 6*a* is located substantially on the center axis of the vibration generating shaft 10.

On the contrary, when the running speed of the vibration compacting roller detected by the running speed detecting sensor 82 is higher than the running speed of the same preset by the running speed setting circuit 84, no electric current is fed from the running speed comparing circuit 85 to the relay 86 but the contact $T_1$ is electrically connected to a contact $T_3$ in the relay 86, whereby no electric current is fed to the solenoid coil SOL2 of the solenoid driven change valve 44 but electric current is fed to the solenoid coil SOL3 of the same, resulting in the rod 7*a* of the hydraulic cylinder 7 being retractively contracted. Consequently, when the eccentric weight 6*a* assumes the operative state as shown in FIG. 2(*b*), the gravity center of the eccentric weight 6*a* is deviated away from the center axis of the vibration generating shaft 10.

In the second embodiment, the eccentricity signal generating unit includes a running speed setting circuit 82 for previously setting a running speed of the vibration compacting roller in operative association with the vibration compacting roller driving system, a running speed comparing circuit 85, and a running speed comparing circuit 85 for comparing the running speed of the vibration compacting roller detected by the running speed detecting sensor 82 with the running speed of the same preset by the running speed setting circuit 84, and when the running speed of the vibration compacting roller detected by the running speed detecting sensor 82 is higher than the running speed of the same preset by the running speed setting circuit 84, an eccentricity signal is generated from the eccentricity signal generating unit.

Referring to FIG. 4 again, when the rod 7*a* of the hydraulic cylinder 7 is displaced to the position corresponding to a predetermined low amplitude while a vibration amplitude changing switch 43 is actuated to selectively assume the operative state represented by a low amplitude (L), a L position sensor 45, i.e., an eccentricity quantity detecting sensor disposed at the substantially intermediate position on the main body of the hydraulic cylinder 7 to serve as eccentric weight eccentricity detecting means stops to feed electric current to the solenoid coil SOL3 of the solenoid driven change valve 44. Subsequently, the solenoid driven change valve 44 is actuated so as to allow the position of the rod 7*a* of the hydraulic cylinder 7 to be changed to an intermediate position, whereby the supplying of pressurized hydraulic oil to the hydraulic cylinder 7 is stopped and the retractive contracting operation of the hydraulic cylinder 7 is interrupted at the foregoing intermediate position. Consequently, while the gravity center of the eccentric weight 6*a* is deviated away from the center axis of the vibration generating shaft 10 to a comparatively small extent as shown in FIG. 2(*b*), the vibration generating shaft 10 is rotated to generate vibrations each having a low amplitude. When the vibration amplitude changing switch 43 is actuated to assume the operative state represented by a high amplitude (H), the rod 7*a* of the hydraulic cylinder 7 moves past the position corresponding to the low amplitude so that a H position sensor 46 stops to feed electric current to the solenoid coil SOL3 of the solenoid driven change valve 44.

Next, a mode of operation of the vibration generating apparatus for the vibration compacting roller constructed in accordance with the second embodiment of the present invention will be described below with reference to FIG. 4 and FIG. 6.

First, before a road surface compacting operation is performed with the vibration compacting roller, an operator sitting on his seat on the vibration compacting roller stops the running of the vibration compacting roller, and then actuates the vibration amplitude changing switch 43 to change the inoperative state of the vibration compacting roller to the operative state represented by a low amplitude (L) or a high amplitude (H) corresponding to the present state of the road surface compacted by the vibration compacting roller. In response to the foregoing actuation of the vibration amplitude changing switch 43, electric current is fed to the solenoid coil SOL1 of the solenoid driven change valve 42 and pressurized hydraulic oil is supplied from the hydraulic pump 41 so that the vibration generating hydraulic motor 9 is rotated, causing the vibration generating shaft 10 to be rotated in a predetermined direction. While the foregoing state is maintained, the vibration compacting roller is held in the running stopped state. Thus, it is obvious that the running speed of the vibration compacting roller is lower than a preset one. In view of the foregoing fact, electric current is fed to the solenoid coil SOL2 of the solenoid driven change valve 44, causing the rod 7*a* of the hydraulic cylinder 7 to be expanded. While the foregoing state is maintained, the gravity center of the eccentric weight is located on the center axis of the vibration generating shaft 10, whereby an intensity of vibration generating force is reduced to a level of zero, although the vibration generating shaft 10 is continuously rotated.

Now, it is assumed that the vibration compacting roller starts to run in the forward direction while the vibration amplitude changing switch 43 is actuated to assume the operative state represented by a high amplitude (H). When the running speed of the vibration compacting roller detected by a running speed sensor becomes higher than the running speed of the same preset by the running speed setting circuit 84, the relay 86 is activated to stop the feeding of electric current to the solenoid coil SOL2 of the solenoid driven change valve 44 but feeds electric current to the solenoid coil SOL3 of the same, whereby the gravity center of the eccentric weight 6*a* is largely deviated away from the center axis of the vibration generating shaft 10. Thus, while the foregoing state is maintained, the vibration generating shaft 10 is rotated so as to allow the vibration generating apparatus to generate vibrations each having a high amplitude.

When the vibration compacting roller runs in the rearward direction after a road surface compacting operation is achieved by a predetermined distance, the vibration of the vibration rolling drum can not be stopped unless the running speed of the vibration compacting roller is reduced to a level lower than the preset one, e.g., even though the forward/rearward movement lever 130 is quickly displaced from the forward movement position A to the rearward movement position C. When the running speed of the vibration compacting roller becomes lower than the preset one in the course of shifting from the forward movement to the rearward movement, the relay 86 is activated to stop the feeding of electric current to the solenoid coil SOL3 of the solenoid driven change valve 44 but feeds electric current to the solenoid coil SOL2 of the same, whereby the rod 7*a* of the hydraulic cylinder 7 is expended, causing the gravity center of the eccentric weight 6*a* to be located on the center axis of the vibration generating shaft 10 again. Consequently, an amplitude of each vibration is reduced to a level of zero, although the vibration generating shaft 10 is continuously rotated. Thereafter, when the vibration compacting roller runs in the rearward direction and the running speed of the vibration compacting roller becomes higher than the preset one, the vibration rolling drum is vibrated with a high amplitude in the same manner as the case the vibration compacting roller runs in the forward direction.

In the case that the vibration amplitude changing switch 43 is actuated so as to allow the operative state of the vibration compacting roller to be changed from the operative state represented by a high amplitude (H) to the operative state represented by a low amplitude (L) in the course of the road surface compacting operation, each changeable actuating operation of the vibration amplitude changing switch 43 is achieved while the vibration compacting roller is held in the vibration stopped state.

When the vibration compacting roller starts to run in the forward direction or in the rearward direction and the running speed of the vibration compacting roller becomes lower than the preset one, the relay 86 is activated to stop the feeding of electric current to the solenoid coil SOL2 of the solenoid driven change valve 44 but feeds electric current to the solenoid coil SOL3 of the same, whereby the gravity center of the eccentric weight 6*a* is deviated away from the center axis of the vibration generating shaft 10 to a comparatively small extent, causing the vibration generating apparatus to generate vibrations each having a low amplitude.

In this embodiment, the vibration generating apparatus includes an eccentricity signal generating unit for generating a signal effective for deviating the gravity center of the eccentric weight away from the axis center of the vibration generating shaft, a vibration mode setting unit capable of selectively setting an applicable amplitude of each vibration, an eccentric weight eccentricity quantity detecting unit for detecting a quantity of eccentricity of the gravity center of the eccentric weight away from the center axis of the vibration generating shaft, and an eccentric weight eccentricity quantity controlling unit for controlling a quantity of eccentricity of the gravity center of the eccentric weight away from the center shaft of the vibration generating shaft with the aid of the vibration mode setting unit for selectively setting an applicable vibration mode and the eccentric weight eccentricity quantity detecting unit in response to a signal transmitted from the eccentricity signal generating unit. With this construction, it is not necessary that the direction of rotation of the vibration generating shaft is changed to the opposite one every time the present vibration mode is changed to another one. Thus, there is no possibility that the eccentric weight intensely collides against an engagement portion of the stationary eccentric weight under the influence of a certain intensity of inertia force induced by the movable eccentric weight, causing components associated with the vibration generating shaft to be damaged or injured like the conventional vibration compacting roller driving system wherein an amplitude of each vibration is changed to another one by changing the direction of rotation of the vibration generating shaft to the opposite one, and moreover, any energy loss does not arise when the present amplitude of each vibration is changed to another one. In addition, since a quantity of eccentricity of the eccentric weight can automatically be controlled in such a manner as to selectively determine an applicable amplitude of each vibration corresponding to the selected vibration mode, a desired amplitude of each vibration can simply be set in contrast with the conventional vibration compacting roller wherein an amplitude of each vibration is changed to another one without any changing of the direction of rotation of the vibration generating shaft as shown in FIG. 13.

Figure 7:
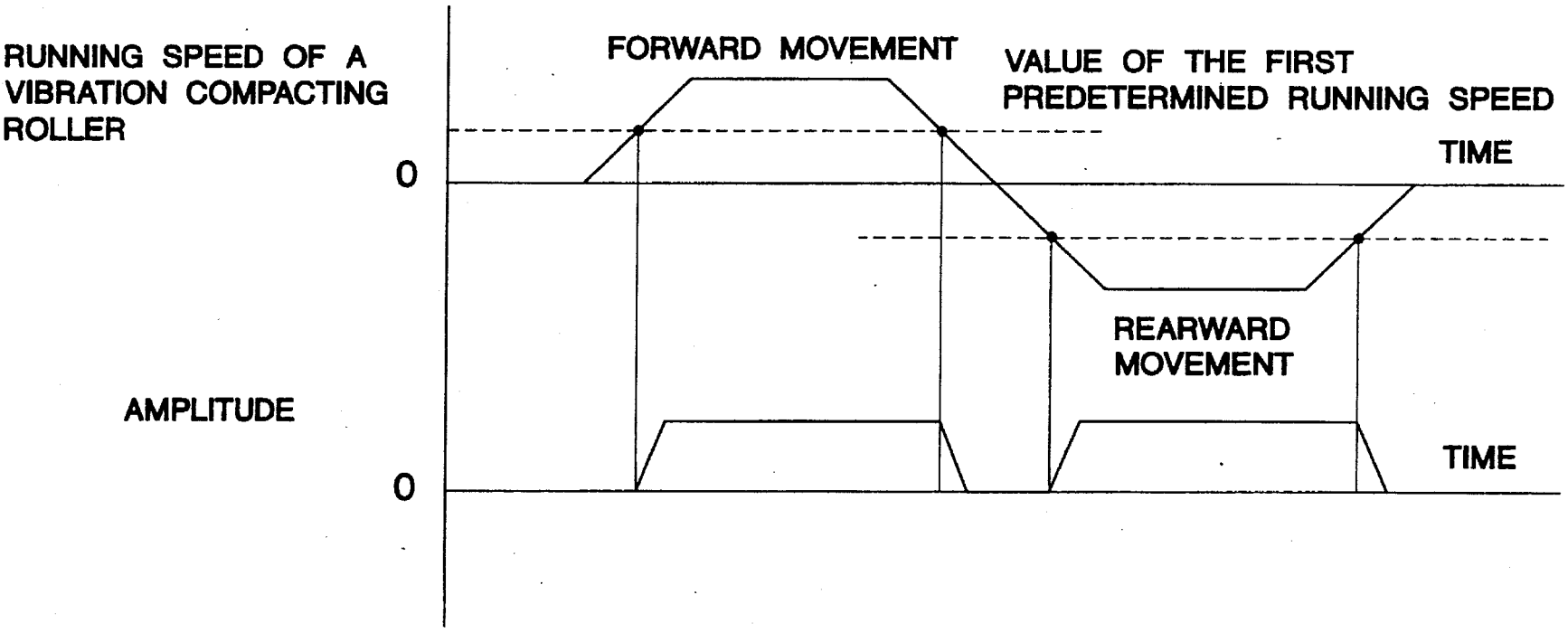
FIG. 7 is a graph which illustrates how the relationship between a running speed of the vibration compacting roller and an amplitude of each vibration generated by the vibration generating apparatus constructed in accordance with the second embodiment of the present invention varies as time elapses under a condition that the vibration compacting roller moves in the forward/rearward direction while the vibration generating shaft disposed in the vibration generating apparatus is steadily rotated.

FIG. 7 is a graph which illustrates how the relationship between a running speed of the vibration compacting roller and an amplitude (high amplitude or low amplitude) of each vibration generated by the vibration generating apparatus constructed in accordance with this embodiment varies as time elapses under a condition that the vibration compacting roller moves in the forward/rearward direction while the vibration generating shaft disposed in the vibration generating apparatus is steadily rotated. As is apparent from the graph, in this embodiment, the vibration generating apparatus exhibits properties which assure that vibrations can stably be generated without any occurrence of resonance of the vibration rolling drum not only during running of the vibration compacting roller in the forward direction but also during running of the same in the rearward direction. Specifically, while the running of the vibration compacting roller is stopped, an amplitude of each vibration is reduced to a level of zero as mentioned above. As long as the running speed of the vibration compacting roller is lower than a first predetermined running speed while the vibration compacting roller runs in the forward direction, an amplitude of each vibration generated by the vibration generating apparatus is held still in the zero level state. When the running speed of the vibration compacting roller exceeds the first predetermined running speed of the same, a quantity of eccentricity of the gravity center of the eccentric weight away from the center axis of the vibration generating shaft is increased from the zero level to a preset value of amplitude. Thereafter, the running speed of the vibration compacting roller is gradually reduced, and when it is reduced in excess of a second predetermined running speed of the vibration compacting roller, a value of amplitude is reduced to a level of zero again. While the running speed of the vibration compacting roller in the forward direction (represented by an absolute value) is held at the value corresponding to a second predetermined running speed of the vibration compacting roller after the running of the vibration compacting roller in the forward direction is reversely changed to the running of the same in the rearward direction, an amplitude of each vibration generated by the vibration generating apparatus (represented by an absolute value) is held still in the zero level state in the same manner as the case that the vibration compacting roller runs in the forward direction. When the running speed of the vibration compacting roller in the rearward direction exceeds the second predetermined speed of the same, a quantity of eccentricity of the gravity center of the eccentric weight away from the center axis of the vibration generating shaft is increased from the zero level to the foregoing preset value of amplitude. Also in the case that the running state of the vibration compacting roller in the rearward direction is reversely changed to the running state of the same in the forward direction via the neutral state, the aforementioned running relationship is repeated with the vibration generating apparatus. Incidentally, the first predetermined speed of the vibration compacting roller and the second predetermined speed of the same may be identical to each other. Otherwise, they may be different from each other.

As is apparent from the above description, when the running speed of the vibration compacting roller is reduced in excess of a certain predetermined value when the running state of the vibration compacting roller in the forward direction is reversely changed to the running state of the same in the opposite direction, a quantity of eccentricity of the gravity center of the eccentric weight away from the center axis of the vibration generating shaft is reduced to a value of zero level, and subsequently, when the running speed of the vibration compacting roller starts to run in the opposite direction after the running of the vibration compacting roller is stopped, a quantity of eccentricity of the gravity center of the eccentric weight away from the center axis of the vibration generating shaft is increased to a value corresponding to a preset amplitude. Thus, while the running of the vibration compacting roller is stopped, an amplitude of each vibration generated by the vibration generating apparatus is normally held at the zero level value. In this embodiment, since ON/OFF of each vibration generated by the vibration generating apparatus is executed by changing a quantity of eccentricity of the gravity center of the eccentric weight away from the center axis of the vibration generating shaft to another one, the operative state of the vibration rolling drum does not coincide with a resonance point. Consequently, once the running of the vibration compacting roller is stopped, the vibration rolling drum is not vibrated, hence here is no occurrence of resonance.

This embodiment has been described above with respect to the case that the vibration generating shaft is steadily rotated. However, although the number of revolutions of the vibration generating shaft coincides with the resonance point defined by vibrations of the vibration rolling drum for the duration that the number of revolutions of the vibration generating shaft is gradually reduced until the rotation of the vibration generating shaft is stopped while the vibration compacting roller is held in the stopped state, the vibration of the vibration rolling drum can be stopped without any occurrence of resonance in response to a signal transmitted from the running speed detecting unit under a condition that the gravity center of the eccentric weight is located substantially on the center axis of the vibration generating shaft before the number of revolution of the vibration generating shaft coincides with the foregoing resonance point.

As long as the vibration generating shaft is steadily rotated when the vibration compacting roller starts to run from the stopped state of running thereof in the forward direction or in the rearward direction, any resonance does not occur with the vibration rolling drum. When the running speed of the vibration compacting roller exceeds a predetermined one, the vibration rolling drum starts to be vibrated from the stopped state of vibration. Also in the case that the number of revolutions of the vibration generating shaft is gradually increased from the vibration stopped state of the vibration generating shaft, the vibration generating shaft can start to be vibrated without any occurrence of resonance, provided that the gravity center of the eccentric weight is located substantially on the center axis of the vibration shaft when the number of revolutions of the vibration generating shaft coincides with the resonance point.

In addition, when the vibration of the vibration rolling drum is stopped while the gravity center of the eccentric weight is located substantially on the center axis of the vibration generating shaft without any stopping of rotation of the vibration generating shaft, few energy loss arises while the generation of vibrations of the vibration generating shaft is stopped, and moreover, a magnitude of load to be borne by the hydraulic pump and the vibration generating hydraulic motor can be reduced. Especially, when the vibration compacting roller performs a rolling operation while the number of revolutions of the vibration generating shaft is maintained in the steady rotating state, an amount of energy loss arising when the generation of vibrations of the vibration generating shaft is stopped can be minimized.

Since the number of revolutions of the vibration generating shaft on an occurrence of resonance is normally lower than the number of revolutions of the vibrating shaft in the steady rotating state, when the running speed of the vibration compacting roller is reduced to a level lower than a predetermined one, the number of revolutions of the vibration generating shaft does not coincide with the resonance point, provided that the number of revolutions of the vibration generating shaft is kept lower than that in the steady rotating state or a predetermined value (i.e., a value higher than the number of revolutions of the vibration generating shaft or a value approximate to the resonance point) without any stopping of rotation of the vibration generating shaft, even though the vibration generating shaft is fabricated with some slightly large machining error and the gravity center of the eccentric weight 6a is deviated away from the center axis of the vibration generating shaft to some extent. Consequently, the vibration rolling drum 1 can advantageously be vibrated without any occurrence of resonance.

While the present invention has been described above with respect to the two preferred embodiments thereof, it should of course be understood that the present invention should not be limited only to these embodiments but various change or modification may be made without any departure from the scope of the present invention as defined by the appended claims.

What is claimed is:

1. A vibrating mechanism which rotates a vibration generating shaft including a moveable eccentric weight to generate a centrifugal force, wherein said vibrating mechanism comprises:

a vibration generating shaft including a pair of supporting members disposed in a parallel spaced relationship while facing each other, a moveable eccentric weight turnably supported on a pivotal shaft, said pivotal shaft being supported by the pair of supporting members in a direction orienting said pivotal shaft at a right angle relative to a center axis of said vibration generating shaft; said pivotal shaft extending between the pair of supporting members, and an eccentric weight driving means for turning said moveable eccentric weight about said pivotal shaft, and said eccentric weight driving means serving to deviate the gravity center of said eccentric weight away from the center axis of said vibration generating shaft, wherein said eccentric weight driving means is composed of an actuator, an actuating rod projecting outside of said actuator, a joint rotatably fitted to said actuating rod, and a connecting rod, one end of said connecting rod being operatively connected to said joint and another end of said connecting rod being operatively connected to said moveable eccentric weight, said connecting rod serving to transform a linear movement of the joint away from said actuator into a turning movement of said eccentric weight about said pivotal shaft.

2. A vibrating mechanism as claimed in claim 1, further comprising:

vibration compacting roller means for rolling solid material into a relatively more compact volume.

3. An apparatus for generating vibrations for a vibration compacting roller with a variable amplitude comprising:

a vibration generating shaft having a center axis;

a moveable eccentric weight having a gravity center disposed in said vibration generating shaft away from said center axis therefrom;

a vibration mechanism capable of changing an amplitude of each vibration to another one by deviating said gravity center of said moveable eccentric weight in said vibration generating shaft away from said center axis therefrom;

an eccentricity signal generating means for generating a signal for deviating the gravity center of said eccentric weight away from said center axis of said vibration generating shaft, a vibration mode setting means capable of selectively setting an amplitude of each vibration to a desired amplitude, an eccentric weight eccentricity quantity detecting means for detecting a quantity of eccentricity of said eccentric weight, and an eccentric weight eccentricity quantity controlling means for controlling a quantity of eccentricity of said eccentric weight with the aid of said vibration mode setting means for selectively setting a desired vibration mode as well as said eccentric weight eccentricity quantity detecting means in response to a signal transmitted from said eccentricity signal generating means.

4. The apparatus as claimed in claim 3, wherein said eccentricity signal generating means includes;

a forward/rearward movement lever neutral position detecting means for detecting whether or not a forward/rearward movement lever, for instructing a command of forward movement, stoppage or rearward movement of said vibration compacting roller to a vibration compacting roller driving system, is located at a neutral position, wherein when said forward/rearward movement lever is located at the position other than said neutral position, said eccentricity signal generating means generates an eccentricity signal.

5. The apparatus as claimed in claim 4, wherein said eccentric weight eccentricity quantity controlling means includes:

an actuator for changing a quantity of eccentricity of the gravity center of said eccentric weight away from the center axis of said vibration generating shaft to another one by turnably displacing said eccentric weight;

a plurality of solenoid driven changing valves for controlling movement of said actuator, and said eccentric weight eccentricity quantity detecting means includes:

a plurality of eccentricity quantity detecting sensors electrically connected to a plurality of solenoid coils of said solenoid driven change valves via a plurality of signal lines for activating said actuator in such a manner as to increase a quantity of eccentricity of said eccentric weight, each of said detecting sensors being activated when a moveable portion of said actuator is displaced by a predetermined distance corresponding to a predetermined quantity of eccentricity.

6. The apparatus as claimed in claim 3, wherein said eccentricity signal generating means includes:

a running speed setting means, for setting a running speed of said vibration compacting roller;

a running speed detecting means for detecting a present running speed of said vibration compacting roller in response to a signal transmitted from a vibration compacting roller driving system; and a running speed comparing means for comparing the running speed of said vibration compacting roller detected by said running speed detecting means with the running speed of said vibration compacting roller set by said running speed setting means, wherein when said running speed of said vibration compacting roller detected by said running speed detecting means is higher than the running speed of the same set by said running speed setting means, said eccentricity signal generates an eccentricity signal.

7. The apparatus as claimed in claim 6, wherein said eccentric weight eccentricity quantity controlling means includes an actuator for changing a quantity of eccentricity of the gravity center of said eccentric weight away from the center axis of said vibration generating shaft to one another by turnably displacing said eccentric weight and solenoid driven change valves for controlling movement of said actuator, and said eccentric weight eccentricity quantity detecting means includes a plurality of eccentric weight quantity detecting sensors electrically connected to solenoid coils of said solenoid driven change valves via signal lines for activating said actuator in such a manner as to increase a quantity of eccentricity of said eccentric weight, each of said detecting sensors being activated when a moveable portion of said actuator is displaced by a predetermined distance corresponding to a predetermined quantity of eccentricity.

8. The apparatus as claimed in claim 3, wherein said eccentric weight eccentricity quantity controlling means includes:

an actuator for changing a quantity of eccentricity of the gravity center of said eccentric weight away from the center axis of said vibration generating shaft to another one by turnably displacing said eccentric weight;

a plurality of solenoid driven changing valves for controlling movement of said actuator, and said eccentric weight eccentricity quantity detecting means includes:

a plurality of eccentricity quantity detecting sensors electrically connected to a solenoid coil of each of said solenoid driven change valves via a plurality of signal lines for activating said actuator in such a manner as to increase a quantity of eccentricity of said eccentric weight, each of said detecting sensors being activated when a moveable portion of said actuator is displaced by a predetermined distance corresponding to a predetermined quantity of eccentricity.

9. An apparatus for generating vibrations for a vibration compacting roller with a variable amplitude comprising:

a vibration generating shaft having a center axis;

a moveable eccentric weight having a gravity center disposed in said vibration generating shaft away from said center axis therefrom;

a vibration mechanism capable of changing an amplitude of each vibration to another one by deviating said gravity center of said moveable eccentric weight in said vibration generating shaft away from said center axis therefrom;

a forward/rearward movement lever neutral position detecting means for detecting a neutral position of a forward/rearward movement lever, and an eccentric weight eccentricity quantity controlling means for locating said gravity center of said eccentric weight substantially on said center axis of said vibration generating shaft in response to a signal transmitted from said forward/rearward lever neutral position detecting means to instruct that said neutral position is detected.

10. An apparatus for generating vibrations for a vibration compacting roller with a variable amplitude comprising:

a vibration generating shaft having a center axis;

a moveable eccentric weight having a gravity center disposed in said vibration generating shaft away from said center axis therefrom;

a vibration mechanism capable of changing an amplitude of each vibration to another one by deviating said gravity center of said moveable eccentric weight in said vibration generating shaft away from said center axis;

a running speed setting means, for setting a running speed of said vibration compacting roller;

a running speed detecting means for detecting said running speed of said vibration compacting roller detected by said running speed detecting means with a running speed of said vibration compacting roller set by said running speed setting means by comparing a signal transmitted from said running speed detecting means with a signal transmitted from said running speed setting means in order to determine whether or not said running speed of said vibration compacting roller detected by said running speed detecting means is higher than said running speed of said vibration compacting roller set by said running speed setting means; and an eccentric weight eccentricity quantity controlling means for locating said gravity center of said eccentric weight substantially on said center axis of said vibration generating shaft in response to a signal transmitted from said running speed detecting means when a running speed of said vibration compacting roller detected by said running speed detecting means is lower than a running speed of said vibration compacting roller set by said running speed setting means, and deviating said gravity center of said eccentric weight away from said center axis of said vibration generating shaft in response to the foregoing signal when said running speed of said vibration compacting roller detected by said running speed detecting means is higher than said running speed of said vibration compacting roller set by said running speed setting means.

11. A method of generating vibrations for a vibration compacting roller with a variable amplitude, comprising:

a step of displacing a moveable eccentric weight in a vibration generating shaft so as to allow the vibration compacting roller to be held in the vibration stopped state by locating the gravity center of said eccentric weight substantially on the center axis of said vibration generating shaft in response to a detection signal of a running speed of said vibration compacting roller when said running speed of said vibration compacting roller is lower than a first predetermined running speed; and a step of displacing a moveable eccentric weight in the vibration generating shaft so as to allow the vibration compacting roller to be held in the vibration generating state by deviating the gravity center of said eccentric weight away from the center axis of said vibration generating shaft in response to said detection signal of said running speed of said vibration compacting roller when said running speed of said vibration compacting roller is higher than a second predetermined running speed.

* * * * *